US011317699B2

(12) United States Patent
Butcher

(10) Patent No.: US 11,317,699 B2
(45) **Date of Patent: *May 3, 2022**

(54) MAKEUP APPLICATION ASSIST DEVICE

(71) Applicant: Kerri Butcher International, Inc., Strongsville, OH (US)

(72) Inventor: Kerri M. Butcher, Strongsville, OH (US)

(73) Assignee: Kerri Butcher International, Inc., Strongsville, OH (US)

( * ) Notice: Subject to any disclaimer, the term of this patent is extended or adjusted under 35 U.S.C. 154(b) by 207 days.

This patent is subject to a terminal disclaimer.

(21) Appl. No.: 16/845,248

(22) Filed: Apr. 10, 2020

(65) Prior Publication Data

US 2020/0237077 A1 Jul. 30, 2020

Related U.S. Application Data

(63) Continuation of application No. 15/287,380, filed on Oct. 6, 2016, now Pat. No. 10,660,424, which is a continuation of application No. 14/095,625, filed on Dec. 3, 2013, now abandoned.

(60) Provisional application No. 61/733,273, filed on Dec. 4, 2012.

(51) Int. Cl.
*A45D 40/30* (2006.01)

(52) U.S. Cl.
CPC ..... *A45D 40/30* (2013.01)

(58) Field of Classification Search
CPC . A61Q 1/025; A61F 9/04; A61F 9/045; A61F 13/12; A45D 40/30; A45D 44/002
USPC ..... D28/8, 7
See application file for complete search history.

(56) References Cited

U.S. PATENT DOCUMENTS

| | | | |
|---|---|---|---|
| 1,566,661 | A | 12/1925 | Essig |
| 2,347,022 | A | 4/1944 | Austin |
| 2,543,458 | A | 2/1951 | Hess |
| 2,917,058 | A | 12/1959 | Ferrar |
| 2,931,369 | A | 4/1960 | Badovinac |
| 3,517,673 | A | 6/1970 | Kim |
| 3,557,653 | A | 1/1971 | Kim |
| 4,118,870 | A | 10/1978 | Dyson |
| 4,807,650 | A | 2/1989 | Bliss |
| 4,936,325 | A | 6/1990 | Davis |
| 4,957,124 | A | 9/1990 | Mooney |
| 5,186,190 | A | 2/1993 | Hirzel |
| 5,358,280 | A | 10/1994 | Scales |
| 5,662,129 | A | 9/1997 | Grenevitch et al. |
| 5,957,142 | A | 9/1999 | Karafilis |
| 6,105,585 | A | 8/2000 | Thomas |
| 6,305,389 | B1 | 10/2001 | Bakken |
| 6,609,457 | B1 | 8/2003 | De Laforcade |
| 7,219,674 | B1 | 5/2007 | Shelley |
| 7,395,554 | B2 | 7/2008 | Kitayama |
| 8,015,981 | B2 | 9/2011 | Soare |

(Continued)

FOREIGN PATENT DOCUMENTS

FR 747190 A 6/1933

*Primary Examiner* — Yogesh P Patel
*Assistant Examiner* — Jennifer Gill
(74) *Attorney, Agent, or Firm* — Pearne & Gordon LLP

(57) ABSTRACT

A method of applying makeup to a user's eye includes providing a stencil that defines a plurality of apertures, the apertures varying in size or distance from each other to form a gradient pattern. The method further includes positioning the stencil relative to the user, and applying makeup through the apertures of the stencil to a specific area around the user's eye.

18 Claims, 20 Drawing Sheets

(56) References Cited

U.S. PATENT DOCUMENTS

| | | | |
|---|---|---|---|
| 8,235,060 | B2 | 8/2012 | Konrad |
| 8,622,063 | B2 | 1/2014 | Haddad |
| 8,997,757 | B1 | 4/2015 | Soare |
| 2004/0107975 | A1 | 6/2004 | Bender |
| 2004/0231694 | A1 | 11/2004 | Rosenblatt |
| 2006/0147119 | A1 | 7/2006 | Takano et al. |
| 2006/0249173 | A1 | 11/2006 | Lawson |
| 2008/0276953 | A1 | 11/2008 | McGee |
| 2009/0194126 | A1 | 8/2009 | Cassese |
| 2009/0241242 | A1 | 10/2009 | Beatty et al. |
| 2010/0018542 | A1 | 1/2010 | Konrad |
| 2010/0018545 | A1 | 1/2010 | Franklin et al. |
| 2013/0263885 | A1 | 10/2013 | Sternad |
| 2015/0114420 | A1 | 4/2015 | Gafni |
| 2015/0296960 | A1 | 10/2015 | Samaco, III |
| 2015/0374101 | A1 | 12/2015 | Levi |

MAKEUP APPLICATION ASSIST DEVICE

CROSS-REFERENCE TO RELATED APPLICATIONS

This is a continuation of U.S. patent application Ser. No. 15/287,380 filed on Oct. 6, 2016, which is a continuation of U.S. patent application Ser. No. 14/095,625 filed on Dec. 3, 2013, which claims the benefit of U.S. Provisional Patent Application No. 61/733,273 filed on Dec. 4, 2012. The content of these applications is herein incorporated by reference in its entirety.

ORIGIN

The innovation disclosed herein relates to the application of makeup and more specifically, to a stencil, screen or stamp to assist in the application of eye shadow and/or eye liner in a gradient and/or fashion design.

BACKGROUND

The typical approach of applying eye shadow includes using one or more brushes, swabs, wands, etc. The process can be laborious and time consuming and often takes much practice and even training to create specific eye shadow designs. Current eye makeup stencils provide only: (i) solid outlines and or parameter outlines for application of eye liner, eye brow makeup, or eye shadow (only for application of eye shadow/eye makeup to the eye lid or the outer half of the eye crease/eye lid and the outer half of the lower eye lid area), (ii) limited one layer eye makeup designs, and (iii) one size fits all stencils or only two sizes.

Further, available eye makeup stencils do not provide: (i) stencils, screens and or stamps corresponding to "layers" of eye shadow application such as base layer(s), contour layer(s), highlight layer(s), crease layer(s), eye liner layer(s), and potentially additional layers to facilitate in the application of eye makeup, (ii) gradient stencils, screens and or stamps, (iii) step by step application guidance on how and where to apply eye shadow for single or multiple layer eye shadow fashion design application process for various gradient and or fashion eye shadow designs, (iv) stencils, screens and or stamps in incremental stencil sizes for various eye shapes, curvatures and sizes which show how and where to apply eye shadow layers to create various gradient and or fashion eye shadow designs for various eye shapes and sizes, (v) stencils, screens and or stamps which guide application of gradient and or fashion eye shadow designs to areas of the eye such as: the inner and outer corners of the eye, over the crease of the eye (or portions of the eye crease), below the eye brow (or portions of), eye brow bone area (or portions of), length of the lower eye lid (or portions of), portions of the eye lid, upper and lower eye lash area, etc., (vi) measurement tools and techniques to aid in measurement of the eye area and selection of appropriate stencil sizes for individual user, (vii) lower eyelid positioning portion, stencil positioning markers and lines which aid in the placement of the stencil on the eye area, or (viii) stencil eye shadow guidance and instructions which aid in the application of eye makeup.

BRIEF SUMMARY OF THE INVENTION

The innovation disclosed herein provides a gradient, perforated and or design cutout stencil device for eye shadow design application and offers the following new components and processes: (i) cutout, gradient and or perforated stencils, stencil and gradient and or perforated screen combinations, gradient and or perforated stencil and screen combinations, perforated and or gradient screens and gradient stamps for application of gradient eye shadow designs, (ii) stencils, screens and or stamps corresponding to "layers" of eye shadow application such as (base layer(s), contour layer(s), highlight layer(s), crease layer(s), eye liner layer(s), etc. to facilitate in the application of eye makeup, (iii) step by step processes for application of various fashion and or gradient eye shadow designs and corresponding eye shadow layer application to the upper and lower eye lid, eye crease, eye brow bone, beneath the eye brow, eye lash line area, and inner and outer corners of the eye, and (iv) cutout, gradient and or perforated eye shadow design application kits and leaves in one size fits all, custom or incremental sizes and flat and or incremental curved shapes which help guide the user in applying eye shadow designs to match to their respective eye shape and size, (v) positioning markers and lines to assist the user in positioning the device on the eye area, (vi) measuring methodologies and tools for the selecting appropriate stencil sizes, (vii) stencil instructions for applying eye shadow, and (viii) lower eye lid positioning portion and cutout used to position the stencil bordering the lower eye lid and properly position the device.

The device is positioned over the upper and lower eye lid and various liquid, powder, cream, and other eye shadows or eye makeup can be applied using a brush, swab, sponge, air brush tool, etc. Eye shadow or eye makeup passes through the cutout area, perforated area and or screen holes of the device or eye makeup is applied to the raised stamp image portion and passed onto the upper and lower eye lid, eye crease, eye brow bone, eye lash line, beneath the eye brow, and or inner and outer corners of the eye.

The components or leaves can be tailored for the application of various gradient and or fashion eye shadow designs such as, but not limited to, natural/daytime, evening/smoky, sophisticated, cat eye, professional, and other designs including variations of the above mentioned designs. Each leaf can be used to apply one or more eye shadow colors to create eye shadow designs and can be use separately or assembled into various combinations and kits. Each kit may include one or more leaves and can include one or multiple steps for the application of various eye shadow designs. The innovation can be custom made for an individual user, one size fits all, or can be available in various incremental sizes in flat and/or incremental curved shapes to fit various common eye sizes, shapes, arches, curves, etc. The device can be flexible, bendable, shapeable and or moldable so the device can be custom made or the user can customize the device to fit the contours of the user's eye shape.

In one aspect of the innovation, a makeup application assist device is provided that includes an upper portion adapted to be placed above an eye and including a first cutout portion and a lower portion adapted to be placed below the eye and including a second cutout portion, wherein the first cutout portion facilitates the application of makeup to specific areas surrounding the eye, and wherein the second cutout portion facilitates the positioning of the makeup application assist device around the eye.

In another aspect, a system that facilitates the application of makeup to an area surrounding an eye area is provided that includes a plurality of makeup application assist devices and an attachment device that connects the plurality of makeup application assist devices to each other, wherein each of the plurality of makeup application assist devices are adapted to facilitate the application of makeup to different areas surrounding an eye and wherein the plurality of makeup application assist devices are removably connected to the attachment device to facilitate the interchangeability of the system.

DETAILED DESCRIPTION

Figure 1:
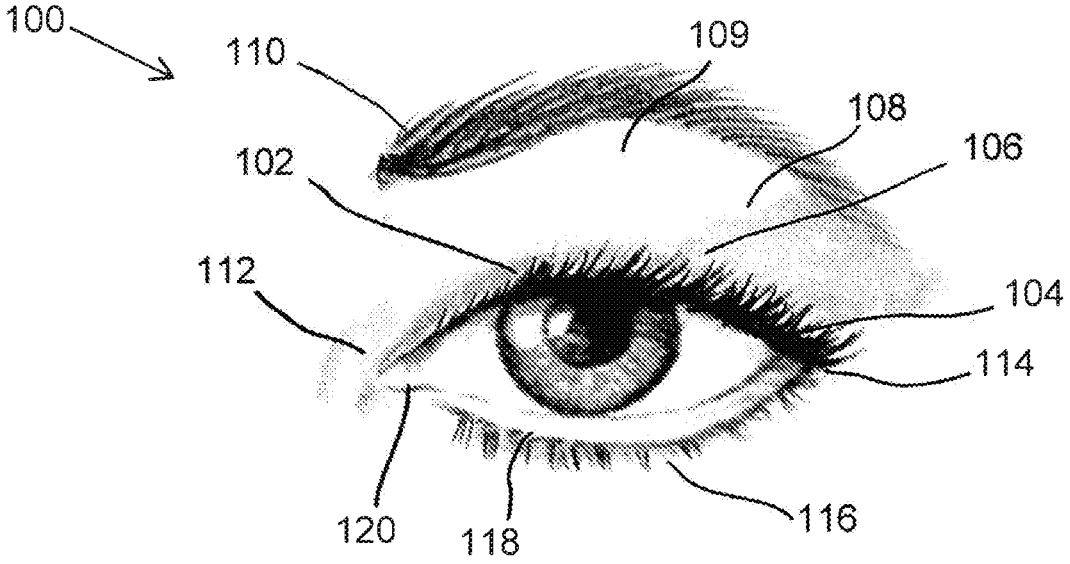
FIG. 1 is a view of an eye illustrating the parts of an area surrounding the eye in accordance with an aspect of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

While specific characteristics are described herein (e.g., thickness), it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

The innovation disclosed herein is a makeup stencil to facilitate the application of makeup around the eye area in accordance with an aspect of the innovation. The makeup stencil may include gradient and or perforated portions for assisting in eye shadow design application and serves as a guide in applying single or multiple step process eye shadow designs. The makeup stencil can include various leaves which are thin (i) gradient, perforated and or cutout stencils, (ii) gradient and or perforated stencil and gradient and or perforated screen combinations, (iii) stencil and gradient and or perforated screen combinations, (iv) gradient and or perforated screens and (v) gradient and or fashion eye shadow design stamps. The leaves can have various cutout shapes and sizes and or varying quantities of perforation and gradient pattern arrangements to facilitate the application of various eye shadow designs.

As will be described in more detail below, to apply makeup the makeup stencil is positioned over the eye and eye shadow is applied such that eye shadow passes through the stencil, thus allowing makeup to be applied onto the upper and lower eye lid, eye crease, eye brow bone, beneath the eye brow, upper and lower lash line and inner and outer corners of the eye. The makeup stencil can be available in one size fits all, custom made for a user, or various incremental sizes.

In other example embodiments, the makeup stencils can be flat, curved, made of a foam material, made of a flexible material, etc. In another embodiment, the makeup stencils can be made of a moldable, bendable, pliable or heatable-pliable material that can be formed to a particular user. Thus, the makeup stencils can be heated and applied to the user such that when the makeup stencils cool to ambient temperature the makeup stencil will conform to the user's contour thereby providing a custom fit.

Referring now to the drawings and specifically to FIGS. 1 and 2A-2F, FIGS. 2A-2F are illustrations of makeup devices (stencils) 200A-200F (collectively 200 where applicable) in accordance with an aspect of the innovation. The makeup devices 200 are adapted to facilitate the application of makeup to different parts of the eye area 100, shown in FIG. 1. Specifically, the makeup devices 200 disclosed herein are adapted to apply makeup to the eye area 100, such as but not limited to the upper eye lid 102, eye crease 106, eyebrow bone 108, area below the eyebrow 109, etc. or portions thereof. It should be appreciated that the makeup devices 200 can be adapted to apply eye shadow and or eye makeup to some, all, portions of and potentially beyond the eye area locations outlined above to create different eye shadow fashion designs.

Thus, the innovative makeup devices 200 also comprise a complete makeup system. The makeup devices 200 disclosed herein may be made from a flexible, pliable material such as but not limited to, plastic, urethane, rubber, latex, cotton, nylon, silicon, etc., or a combination thereof. Further, the makeup devices 200 may be transparent or opaque and can be held in place by the user or can be attached to a hinged mechanism and held over the eye lid by the user. Still further, as will be described in more detail below, the makeup devices 200 can be available in different incremental shapes and sizes and or fitted to a users' eye shape and size.

The eye area 100 includes an upper eye lid 102, an upper eye lash line 104, an eye crease 106, an eyebrow bone 108, an eyebrow 110, an inner eye corner 112, an outer eye corner 114, a lower eye lid 116, a lower eye lash line 118, and a tear duct 120. FIG. 1 will be referenced throughout the disclosure relating to the application of makeup.

Figure 2A:
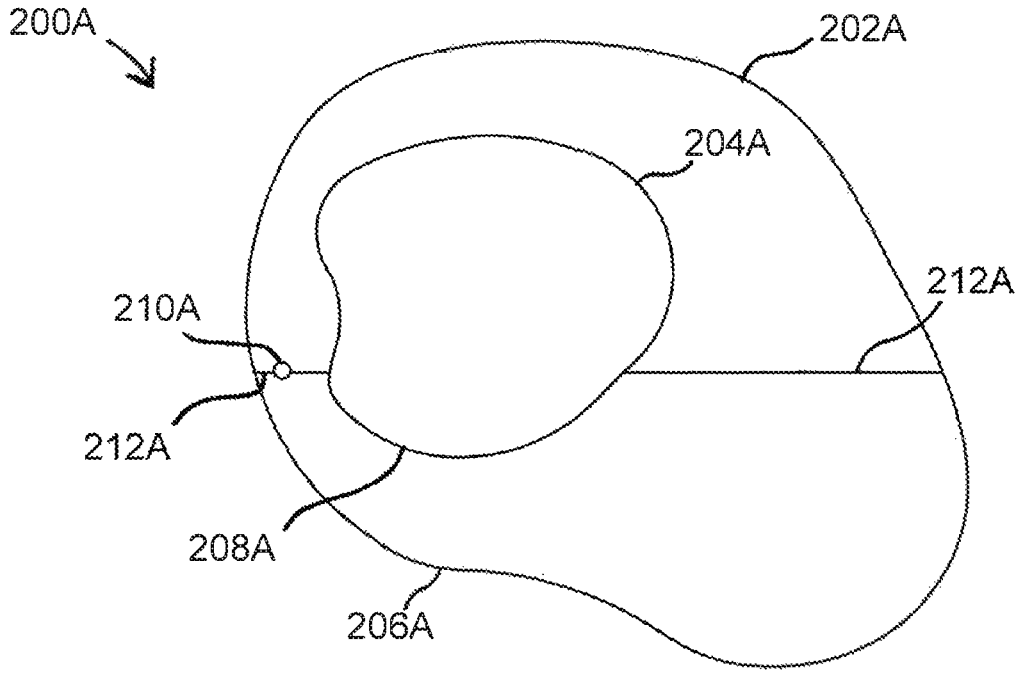
FIGS. 2A-I are example embodiments of makeup application assist devices in accordance with an aspect of the innovation.

FIG. 2A is an example embodiment of a first makeup application assist device (base stencil) 200A adapted to facilitate the application of a base makeup color to the eye area 100 or a portion thereof. The makeup device 200A includes an upper (upper eye) portion 202A having a first cutout portion 204A defined therein and a lower (lower eye) portion 206A having a second cutout (positioning) portion 208A defined therein. When the makeup device 200A is properly positioned over the eye area 100, the first cutout portion 204A exposes portions of the eye area 100 mentioned above to facilitate the application of a base makeup color, such as but not limited to a base color of eye shadow.

The second cutout portion 208A is adapted to facilitate the positioning of the first makeup device 200A. Specifically, the second cutout portion 208A is approximately the size of the diameter of the eye and is designed to fit around a curvature the lower eye lid 116. The inner corner, outer corner, and top of the second cutout portion 208A may be positioned over the tear duct 120, the outer corner of the eye 114, and the upper and or lower eye lash area respectively thereby properly aligning the first makeup device 200A on the eye area 100. Thus, the second cutout portion 208A assists the user in properly positioning the makeup device 200A on the eye area. The second cutout portion 208A can be available in different incremental shapes and sizes and or fitted to an individuals' eye shape and size.

The first makeup device 200A can further include one or more positioning indicators comprised of one or more positioning markers (e.g., aperture, dot, etc.) 210A and one or more positioning lines 212A that assist the user in positioning the first makeup device 200A on the eye area 100. The positioning marker 210A is used to position the first makeup device 200A over the user's tear duct 120. The positioning lines 212A are used to line-up the first makeup device 200A with the inner and outer eye corners 112, 114 where the upper and lower eye lash lines 104, 118 meet and properly position the first makeup device 200A. The positioning marker 210A and positioning lines 212A along with the second cutout portion 208A work in conjunction to properly position the first makeup device 200A over the user's eye area 100. Specifically, to properly position the first makeup device 200A, the positioning marker 210A is positioned over the user's tear duct 120 and the positioning lines 212A are lined up with the inner and outer eye corners 112, 114 where the upper and lower eye lash lines 104, 118 meet.

Figure 2B:
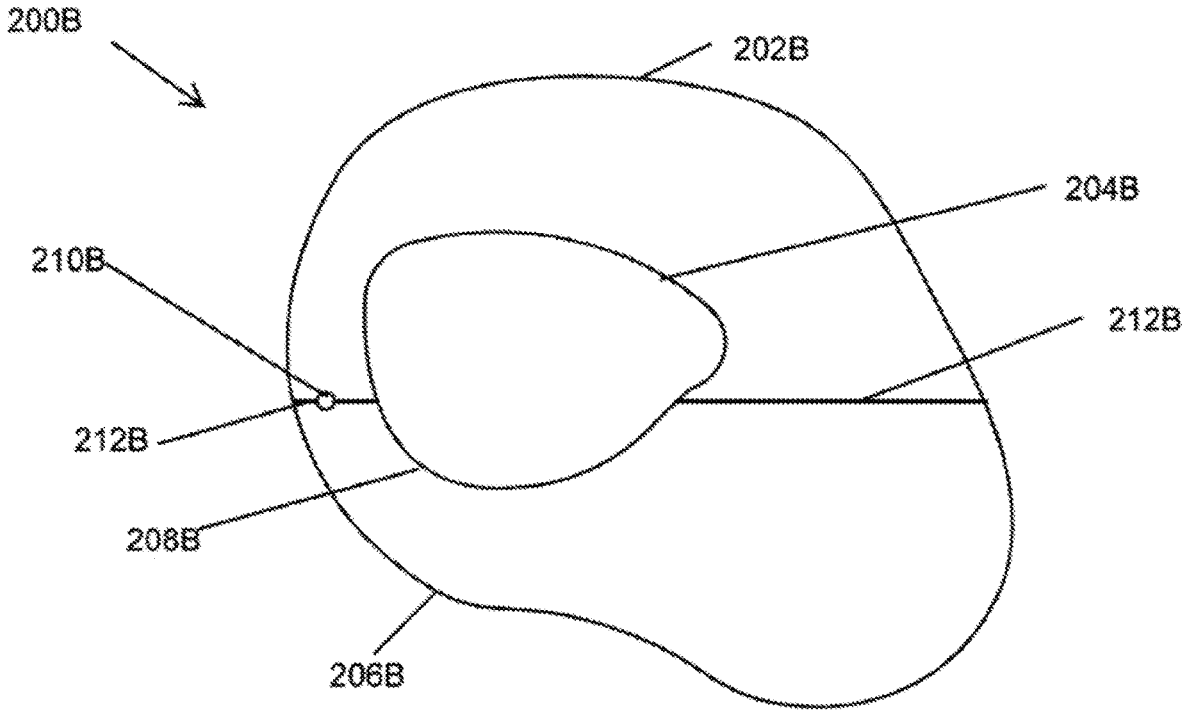

FIG. 2B is an example embodiment of a second makeup application assist device (contour stencil) 200B, adapted to facilitate the application of makeup to the eye area 100, such as but not limited to, the upper and or lower eye lids 102, 116, eye crease 106, eye brow bone 108, and or outer corner of the eye 114 or a portion thereof. The second makeup device 200B includes an upper (upper eye) portion 202B having a first cutout portion 204B defined therein and a lower (lower eye) portion 206B having a second cutout (positioning) portion 208B defined therein. When the second makeup device 200B is properly positioned over the eye area 100, the first cutout portion 204B exposes the upper eye lid 102 to facilitate the application of makeup (e.g., eye shadow) to the upper eye lid 102 and or the lower eye lid 116 or portions thereof.

The second cutout portion 208B is adapted to facilitate the positioning of the second makeup device 200B. Specifically, the second cutout portion 208A is approximately the size of the diameter of the eye and is designed to fit around a curvature the lower eye lid 116. The inner corner, outer corner, and top of the second cutout portion 208B may be positioned over the tear duct 120, the outer corner of the eye 114, and the upper and or lower eye lash area respectively thereby properly aligning the first makeup device 200B on the eye area 100. Thus, the second cutout portion 208B assists the user in properly positioning the second makeup device 200B on the eye area. The second cutout portion 208B can be available in different incremental shapes and sizes and or fitted to an individuals' eye shape and size.

The second makeup device 200B can further include one or more positioning indicators comprised of one or more positioning markers (e.g., aperture, dot, etc.) 210B and one or more positioning lines 212B that assist the user in positioning the second makeup device 200B on the eye area 100. The positioning marker 210B is used to position the second make up device 200B over the user's tear duct 120. The positioning lines 212B are used to line-up the makeup device 200B with the inner and outer eye corners 112, 114 where the upper and lower eye lash lines 104, 116 meet and properly position the second makeup device 200B. The positioning marker 210B and positioning lines 212B along with the second cutout portion 208B work in conjunction to properly position the second makeup device 2008 over the user's eye area 100. Specifically, to properly position the second makeup device 200B, the positioning marker 210B is positioned over the user's tear duct 120 and the positioning lines 212B are lined up with the inner and outer eye corners 112, 114 where the upper and lower eye lash lines 104, 116 meet.

Figure 2C:
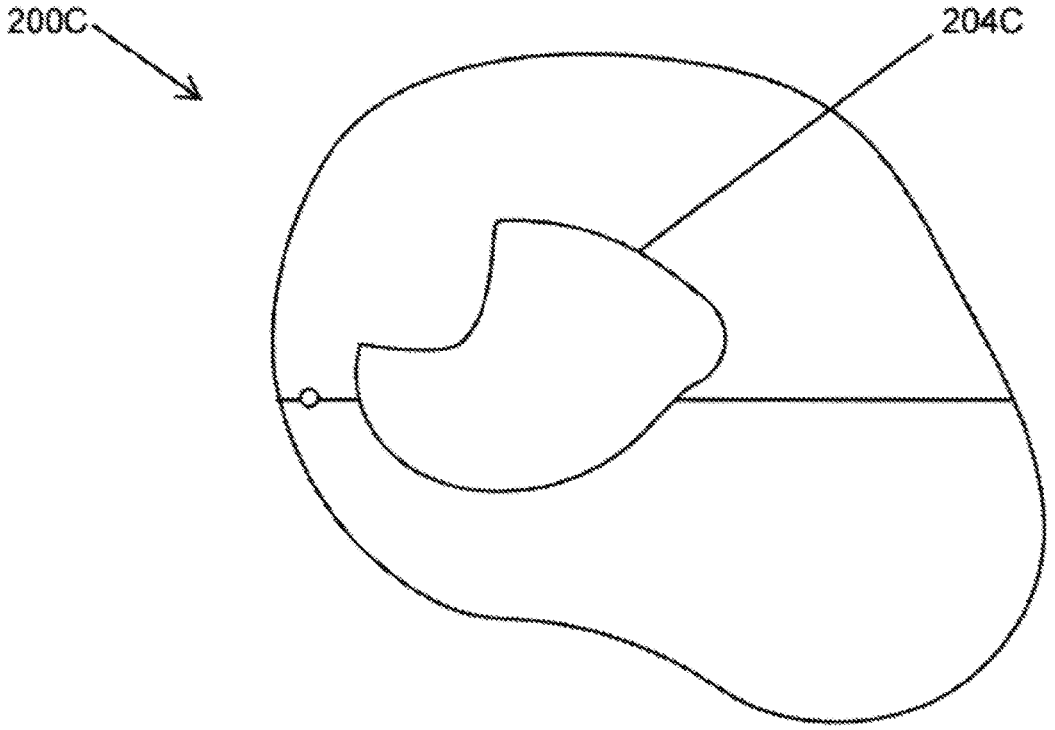

FIG. 2C is an illustration of another example embodiment of the second makeup device (contour stencil) 200C, adapted to facilitate the application of makeup to the eye area 100 or a portion thereof. The example makeup device 200C is the same as the example embodiment in FIG. 2B except that the first cutout portion 204C has a different shape. Thus, the application of makeup to the upper eye lid 102 and or lower eye lid 116, eye crease 106, eye brow bone 108, and or outer corner of the eye 114 will have a different shape than with the second embodiment illustrated in FIG. 2B. Therefore, it is to be understood that the cutout portions and, hence the stencil, can have many different shapes thereby providing many different designs.

Figure 2D:
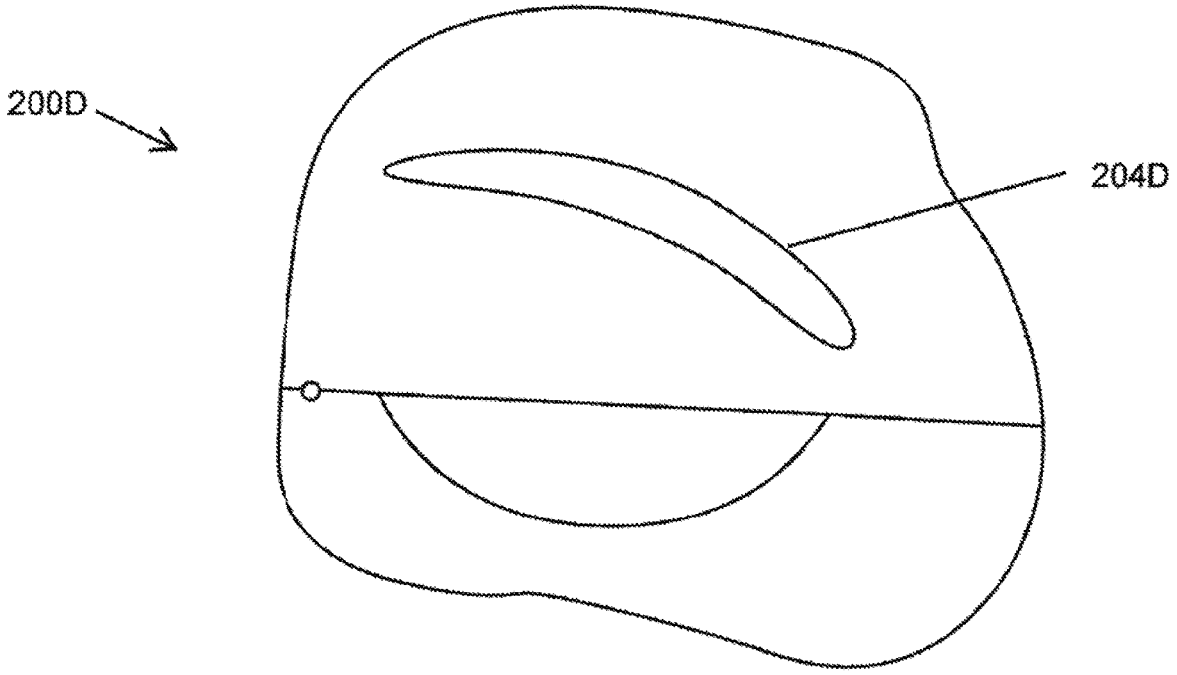

FIG. 2D is an example embodiment of another makeup device (contour "Chic" stencil) 200D, adapted to facilitate the application of makeup to the eye area 100 or a portion thereof. The example makeup device 200D is the same as the example embodiment in FIG. 2B except that the first cutout portion 2041) has a different shape, known as a contour "Chic" design. Thus, the application of makeup to the upper eye lid 102 and or the lower eye lid 116, eye crease 106, eye brow bone 108, and or outer corner of the eye 114 will have a different shape than with the second embodiment illustrated in FIG. 2B. Therefore, it is to be understood that the cutout portions and, hence the stencil, can have many different shapes thereby providing many different designs.

Figure 2E:
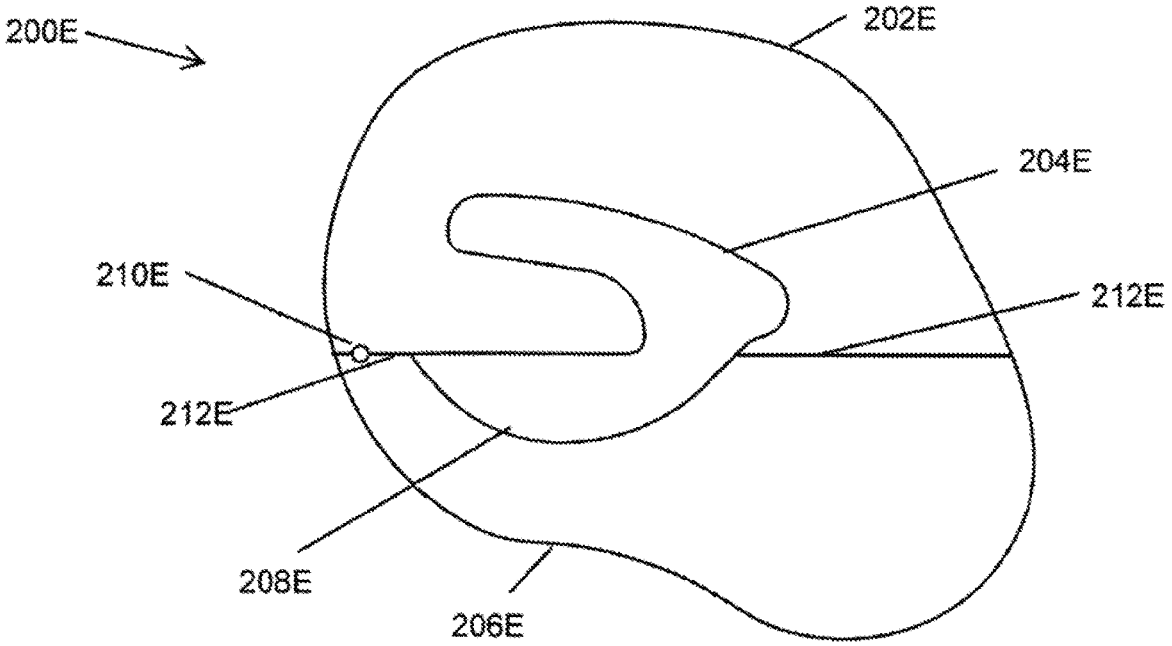

FIG. 2E is an example embodiment of a third makeup application assist device (eye crease stencil) 200E, adapted to facilitate the application of makeup to the eye area 100, such as but not limited to the eye crease 106 eye brow bone 108, and or outer corner of the eye 114 or a portion thereof. The third makeup device 200E includes an upper (upper eye) portion 202E having a first cutout portion 204E defined therein and a lower (lower eye) portion 206E having a second cutout (positioning) portion 208E defined therein. When the third makeup device 200E is properly positioned over the eye area 100, the first cutout portion 204E exposes the eye lid crease 106, eye brow bone 108, and or outer corner of the eye 114 or portions thereof to facilitate the application of makeup (e.g., eye shadow) to the eye crease 106 or a portion thereof.

The second cutout portion 208E is adapted to facilitate the positioning of the third makeup device 200E. Specifically, the second cutout portion 208E is approximately the size of the diameter of the eye and is designed to fit around a curvature the lower eye lid 116. The inner corner, outer corner, and top of the second cutout portion 208E may be positioned over the tear duct 120, the outer corner of the eye 114, and the upper and or lower eye lash area respectively thereby properly aligning the third makeup device 200E on the eye area 100. Thus, the second cutout portion 208E assists the user in properly positioning the third makeup device 200E on the eye area. The second cutout portion 208E can be available in different incremental shapes and sizes and or fitted to an individuals' eye shape and size.

The third makeup device 200E can further include one or more positioning indicators comprised of one or more positioning markers (e.g., aperture, dot, etc.) 210E and one or more positioning lines 212E that assist the user in positioning the third makeup device 200E on the eye area 100. The positioning marker 210E is used to position the third make up device 200E over the user's tear duct 120. The positioning lines 212E are used to line-up the third makeup device 200E with the inner and outer eye corners 112, 114 where the upper and lower eye lash lines 104, 116 meet and properly position the third makeup device 200E. The positioning marker 210E and positioning lines 212E along with the second cutout portion 208E work in conjunction to properly position the third makeup device 200E over the user's eye area 100. Specifically, to properly position the second makeup device 200E, the positioning marker 210E is positioned over the user's tear duct 120 and the positioning lines 212E are lined up with the inner and outer eye corners 112, 114 where the upper and lower eye lash lines 104, 116 meet.

Figure 2F:
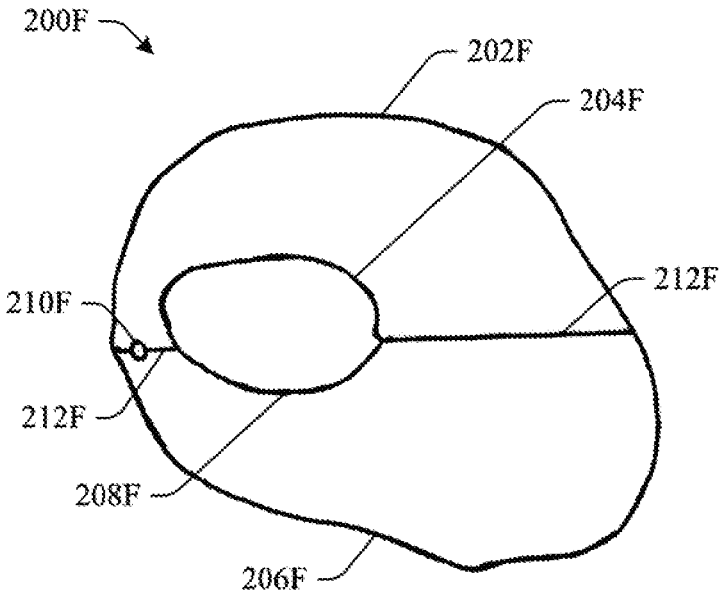

FIG. 2F is an example embodiment of a fourth makeup application assist device (highlight stencil) 200F, adapted to facilitate the application of makeup to the eye area 100, such as but not limited to the eye brow bone 108, the area below the eye brow 109, inner corner of the eye 112, and or the upper eye lid 106 or a portion thereof. The fourth makeup device 200F includes an upper (upper eye) portion 202F having a first cutout portion 204F defined therein and a lower (lower lid) portion 206F having a second cutout (positioning) portion 208F defined therein. When the fourth makeup device 200F is properly positioned over the eye area 100, the first cutout portion 204F exposes the eyebrow bone 108, the area below the eye brow 109, inner corner of the eye 112, and or the upper eye lid 106 to facilitate the application of makeup (e.g., eye shadow) to the eyebrow bone 108, the area below the eye brow 109, inner corner of the eye 112, and or the upper eye lid 106 or portions thereof.

The second cutout portion 208F is adapted to facilitate the positioning of the fourth makeup device 200F. Specifically, the second cutout portion 208F is approximately the size of the diameter of the eye and is designed to fit around a curvature the lower eye lid 116. The inner corner, outer corner, and top of the second cutout portion 208F may be positioned over the tear duct 120, the outer corner of the eye 114, and the upper and or lower eye lash area respectively thereby properly aligning the fourth makeup device 200F on the eye area 100. Thus, the second cutout portion 208F assists the user in properly positioning the fourth makeup device 200F on the eye area. The second cutout portion 208F can be available in different incremental shapes and sizes and or fitted to an individuals' eye shape and size.

The fourth makeup device 200F can further include one or more positioning indicators comprised of one or more positioning markers (e.g., aperture, dot, etc.) 210F and one or more positioning lines 212F that assist the user in positioning the fourth makeup device 200F' on the eye area 100. The positioning marker 210F' is used to position the fourth make up device 200F over the user's tear duct 120. The positioning lines 212E are used to line-up the fourth makeup device 200F with the inner and outer eye corners 112, 114 where the upper and lower eye lash lines 104, 116 meet and properly position the fourth makeup device 200F. The positioning marker 210F and positioning lines 212F along with the second cutout portion 208F work in conjunction to properly position the fourth makeup device 200F over the user's eye area 100. Specifically, to properly position the fourth makeup device 200F, the positioning marker 210F is positioned over the user's tear duct 120 and the positioning lines 212F are lined up with the inner and outer eye corners 112, 114 where the upper and lower eye lash lines 104, 116 meet.

Figure 2G:
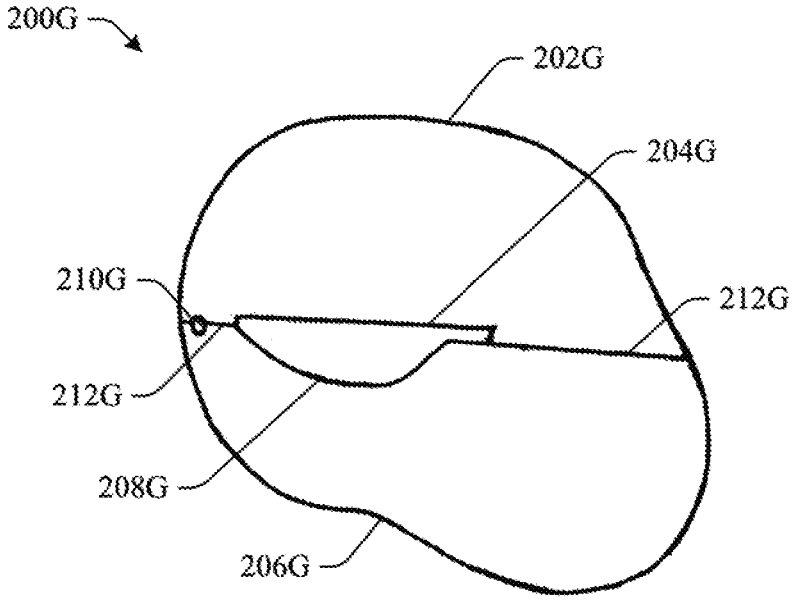

FIG. 2G is an example embodiment of a fifth makeup application assist device (eye liner stencil) 200G, adapted to facilitate the application of makeup to the eye area 100, such as but not limited to the upper and lower eye lash lines 104, 118, upper and or lower eye lid 106, 116, and or outer corner of the eye 114 or portions thereof. The fifth makeup device 200G includes an upper (upper eye) portion 202G having a first cutout portion 204G defined therein and a lower (lower lid) portion 206G having a second cutout (positioning) portion 208G defined therein. When the fifth makeup device 200F is properly positioned over the eye area 100, the first cutout portion 204G exposes the upper and or lower eye lash lines 104, 118, upper and or lower eye lid 106, 116, and or outer corner of the eye 114 to facilitate the application of makeup (e.g., eye liner) to the upper and or lower eye lash lines 104, 118, upper and or lower eye lid 106, 116, and or outer corner of the eye 114 or a portion thereof.

The second cutout portion 208G is adapted to facilitate the positioning of the fifth makeup device 200G. Specifically, the second cutout portion 208G is approximately the size of the diameter of the eye and is designed to fit around a curvature the lower eye lid 116. The inner corner, outer corner, and top of the second cutout portion 208G may be positioned over the tear duct 120, the outer corner of the eye 114, and the upper and or lower eye lash area respectively thereby properly aligning the fifth makeup device 200G on the eye area 100. Thus, the second cutout portion 208G assists the user in properly positioning the fifth makeup device 200G on the eye area. The second cutout portion 208G can be available in different incremental shapes and sizes and or fitted to an individuals' eye shape and size.

The fifth makeup device 200G can further include one or more positioning indicators comprised of one or more positioning markers (e.g., aperture, dot, etc.) 210G and one or more positioning lines 212G that assist the user in positioning the fifth makeup device 200G on the eye area 100. The positioning marker 210G is used to position the fifth makeup device 200G over the user's tear duct 120. The positioning lines 212G are used to line-up the fifth makeup device 200G with the inner and outer eye corners 112, 114 where the upper and lower eye lash lines 104, 116 meet and properly position the fifth makeup device 200G. The positioning marker 210G and positioning lines 212G along with the second cutout portion 208G work in conjunction to properly position the fifth makeup device 200G over the user's eye area 100. Specifically, to properly position the fifth makeup device 200G, the positioning marker 210G is positioned over the user's tear duct 120 and the positioning lines 212G are lined up with the inner and outer eye corners 112, 114 where the upper and lower eye lash lines 104, 116 meet.

Figure 2I:
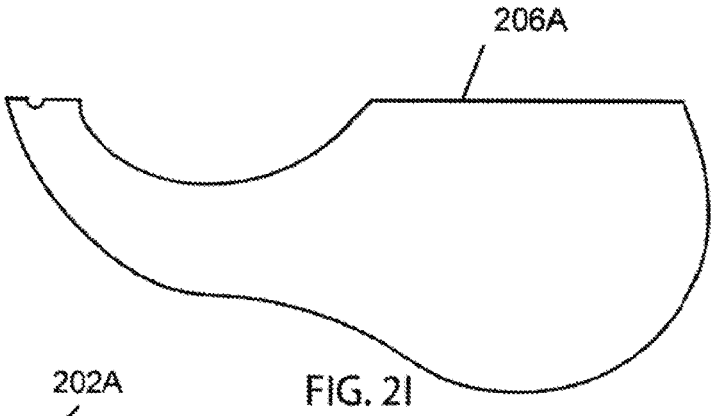
Figure 2H:
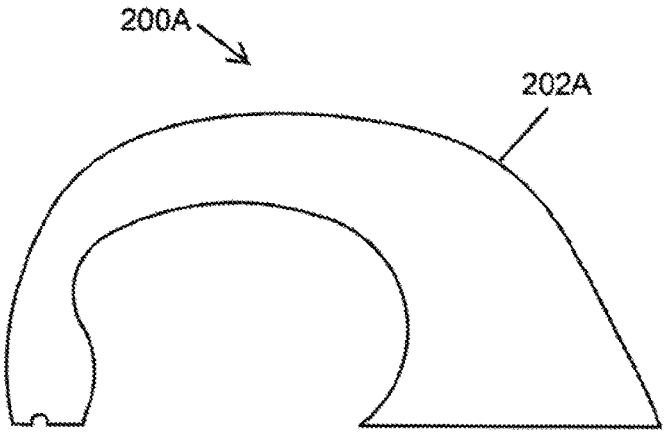

Although the example embodiments illustrated in FIGS. 2A-2G are single piece makeup devices 200A-200G (collectively 200), it is to be understood that any makeup device 200 disclosed herein can be two separate pieces, as shown in FIGS. 2H and 2I. Specifically, FIGS. 2H and 2I illustrate the example makeup device 200A of FIG. 2A as two separate pieces, the upper portion 202A and the lower portion 206A. All other features of the makeup device are the same as explained above and will not be repeated.

Figure 3:
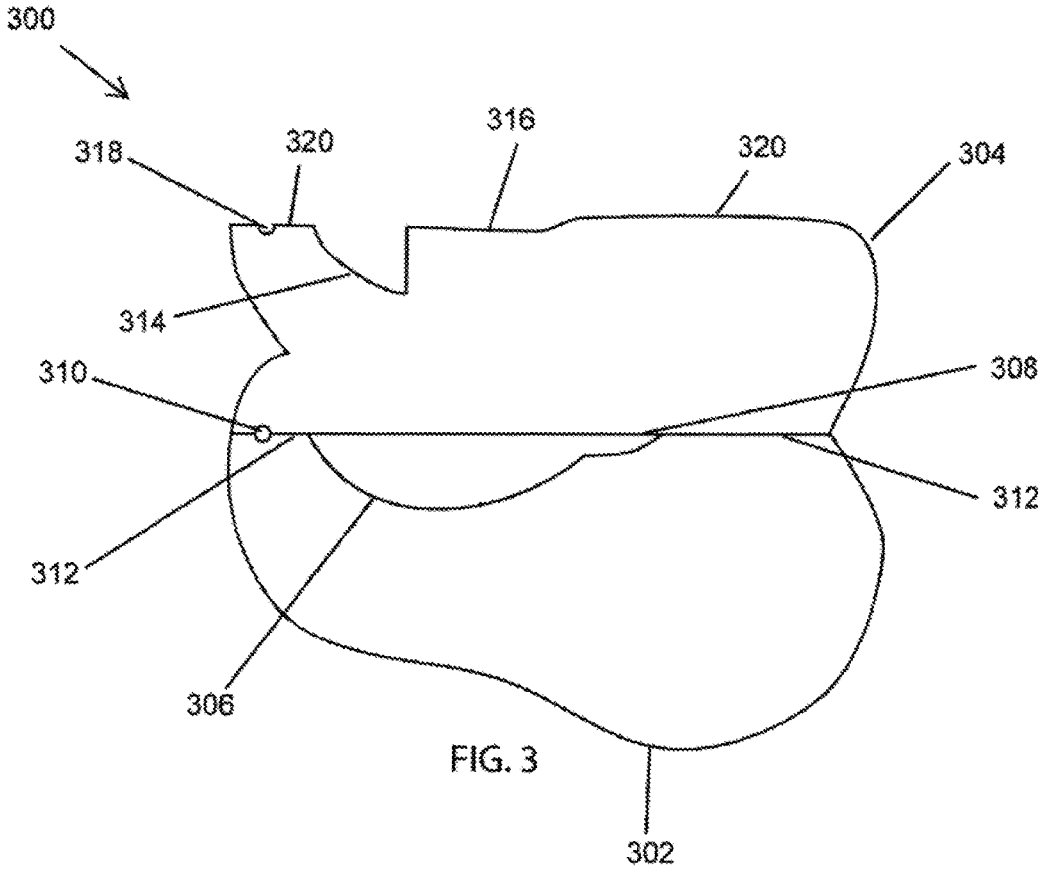
FIG. 3 is an example embodiment of a combination makeup application assist device in accordance with an aspect of the innovation.

FIG. 3 is another example embodiment of a makeup device (stencil) 300 that includes both the upper and lower portions of the stencil in accordance with an aspect of the innovation. Specifically, the makeup device 300 illustrated in FIG. 3 is a combination makeup device 300 that includes a first portion 302 adapted to facilitate the application of makeup to an eye area above the eye and a second portion 304 adapted to facilitate the application of makeup to the eye area below the eye.

The first portion 302 includes a first cutout portion 306 adapted to facilitate the positioning of the combination makeup device 300 and a second cutout portion 308 adapted to facilitate the application of makeup to an area above the eye. The first portion 302 also includes one or more positioning indicators comprised of one or more positioning markers (e.g., aperture, dot, etc.) 310 and one or more positioning lines 312 that assist the user in positioning the first portion 302 of the makeup device 300 on the eye area 100 similar to the positioning indicators described above.

The second portion 304 includes a third cutout portion 314 adapted to facilitate the positioning of the combination makeup device 300 and a fourth cutout portion 316 adapted to facilitate the application of makeup to an area below the eye. The second portion 304 also includes one or more positioning indicators comprised of one or more positioning markers (e.g., aperture, dot, etc.) 318 and one or more positioning lines 320 that assist the user in positioning the second portion 304 of the makeup device 300 on the eye area 100 similar to the positioning indicators described above.

FIGS. 4A-4J illustrate example embodiments of makeup application assist devices 400A-400J (collectively "400-1" where applicable) in accordance with an aspect of the innovation. The example embodiments illustrated in FIGS. 4A-4J are similar to the example embodiment illustrated in FIG. 2A, thus, like features will be referenced but not described in detail. The makeup devices 400-1 are adapted to facilitate the application of makeup to an eye area above the eye and include an upper (upper eye) portion 402 having a first cutout (upper application) portion 404 defined therein and a lower (lower lid) portion 406 having a second cutout (lower positioning) portion 408 defined therein, one or more positioning indicators comprised of one or more positioning markers (e.g., aperture, dot, etc.) 410 and one or more positioning lines 412 that assist the user in positioning the makeup device 400-1 on the eye area 100.

Figure 4A:
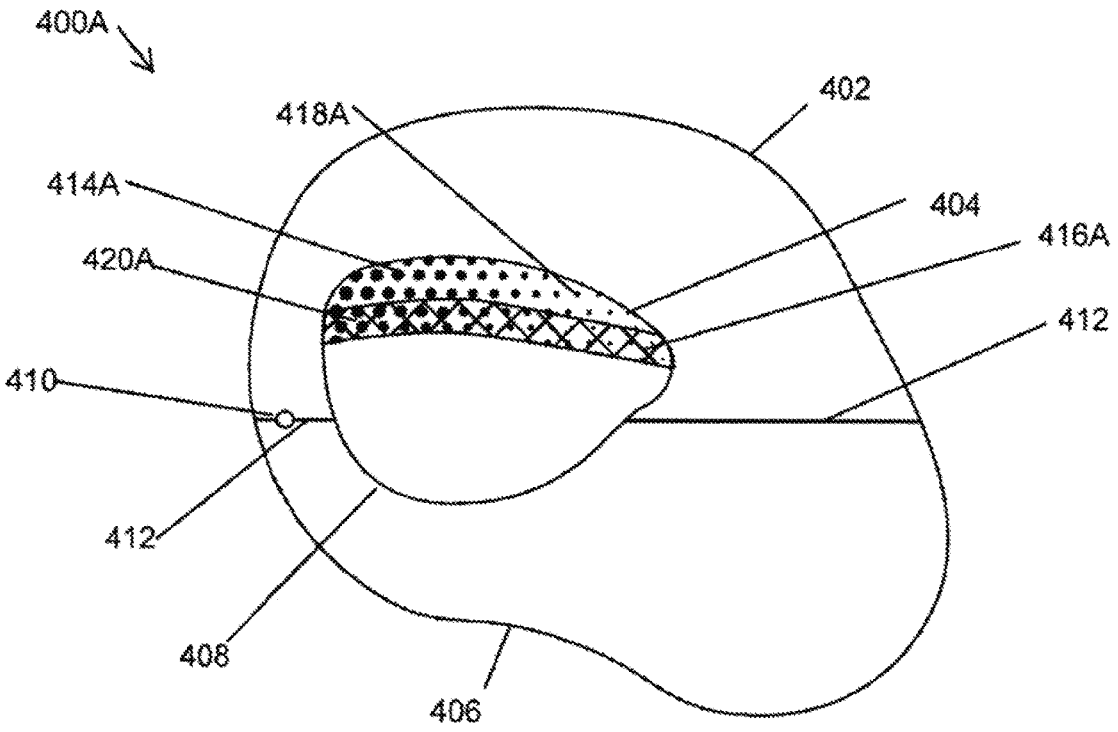
FIGS. 4A-4J are example embodiments of makeup application assist devices adapted to facilitate the application of makeup to areas above the eye in accordance with an aspect of the innovation.
Figure 4B:
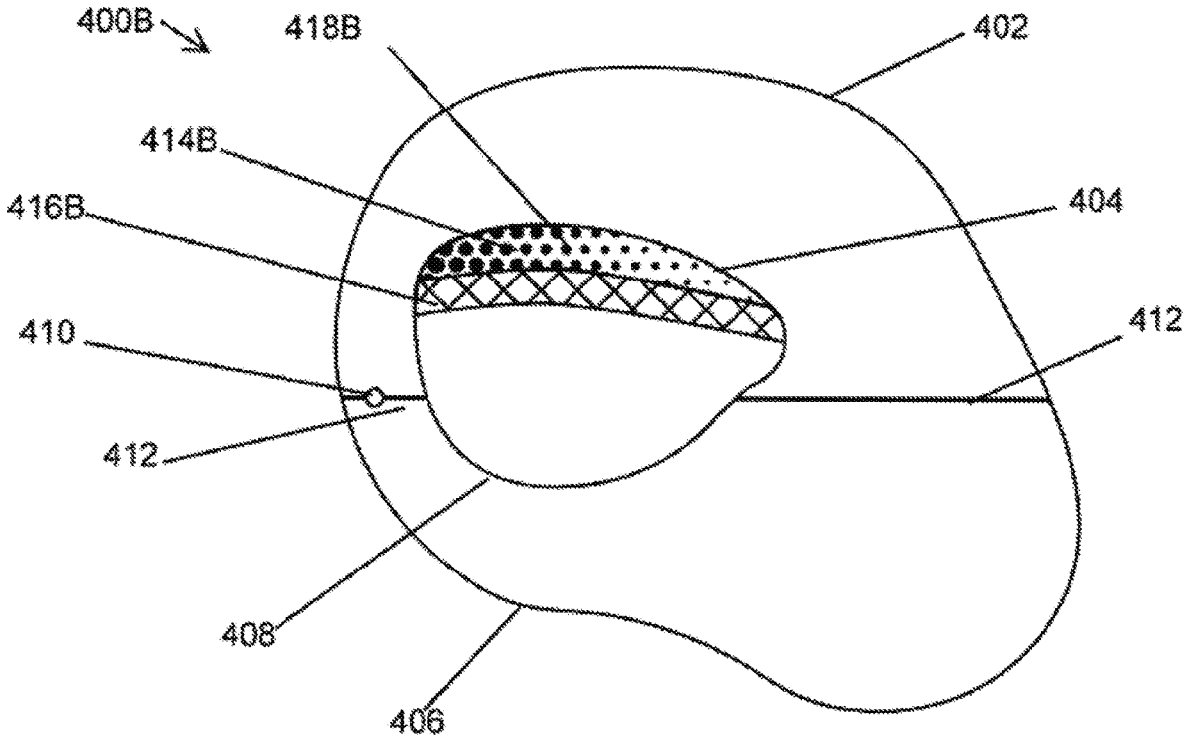

The example embodiments in FIGS. 4A and 4B further include a first pass-through (perforated) portion 414A, 414B and a second pass-through (screen) portion 416A, 416B in accordance with another aspect of the innovation. The perforated portion 414A, 414B is attached to the upper portion 402 and can include apertures 418A, 418B to allow the makeup to pass through the perforated portion 414A, 414B onto a specific location near the user's eye (e.g., upper eye lid, eye crease, inner and outer corners of the eye, eye brow bone, upper lash line underneath the eye brow area, etc.). The apertures 418A, 414B may vary in size, may vary in distance from each other, may vary in quantity in any and all direction such as but not limited to, from top to bottom, bottom to top, sided to side, from the middle outward, from the outer edge inward, etc. to form a gradient pattern to create various designs. Alternatively, the perforated portion 414A, 414B can include cutout shapes and designs with are arranged to create various eye makeup designs.

The screen portion 416A, 416B is a mesh like material and can be attached to the perforated portion 414A, 414B. The screen portion 416A may include multiple screen apertures 420A (FIG. 4A) that allows the makeup to pass through the screen portion 416A onto a specific location near the user's eye (e.g., upper eye lid, eye crease, inner and outer corners of the eye, eye brow bone, upper lash line, underneath the eye brow area, etc.). The screen apertures 420A may vary in size gradience and pattern to create various designs. For example, the screen apertures 420A may be configured such that they form a gradient type pattern such that when the makeup is applied, the shade of the makeup varies in intensity in any and all directions (e.g., from top to bottom, bottom to top, side to side, etc.). Referring to FIG. 4B, it is to be understood, that the screen portion 416B may not include screen apertures and, thus, does not create a gradient design.

Figure 4C:
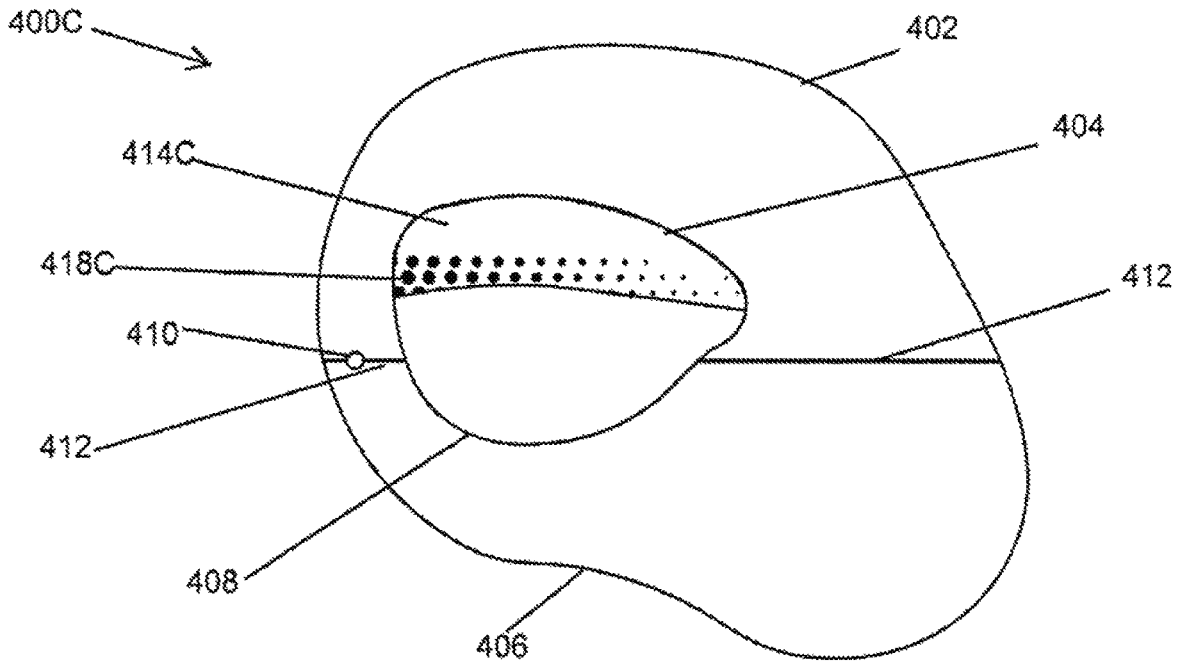
Figure 4D:
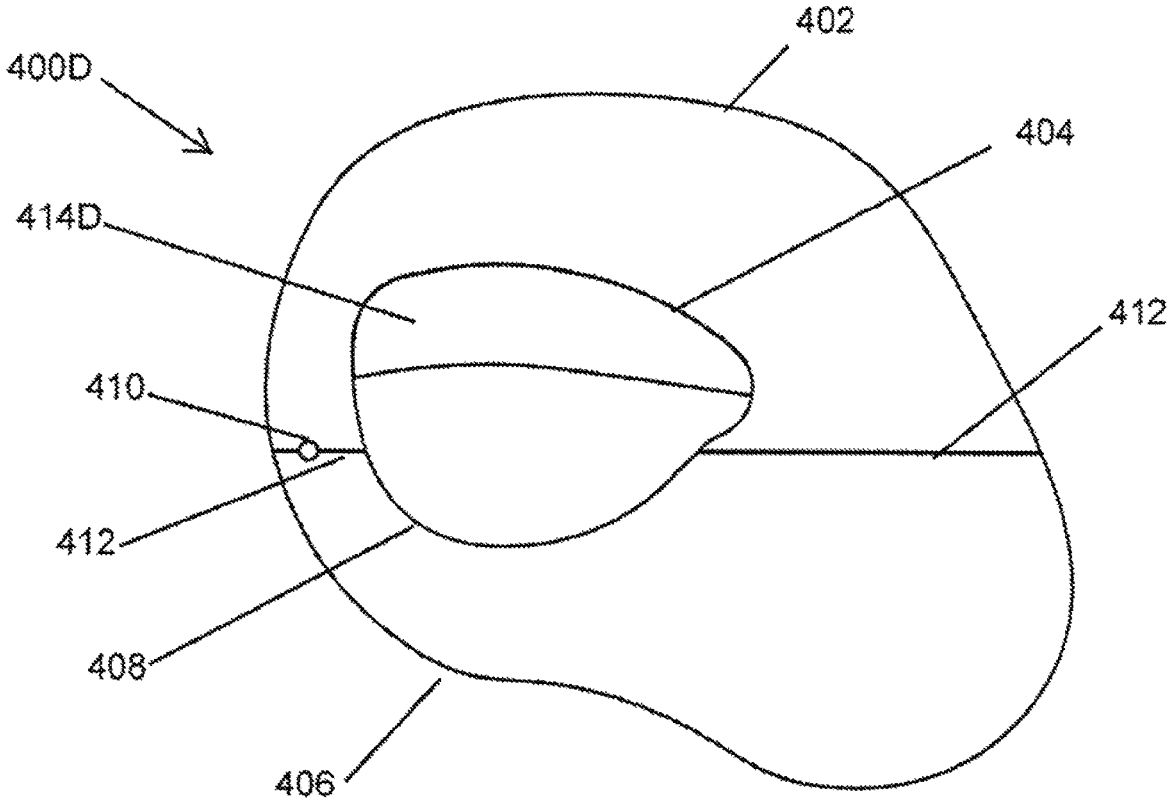

The example embodiments in FIGS. 4C and 4D further include a pass-through (perforated) portion 414C, 414D in accordance with another aspect of the innovation. The perforated portion 414C is attached to the upper portion 402 and can include apertures 418C (FIG. 4C) to allow the makeup to pass through the perforated portion 414C onto a specific location near the user's eye (e.g., upper eye lid, eye crease, inner and outer corners of the eye, eye brow bone, upper lash line underneath the eye brow area, etc.). The apertures 418C may vary in size, gradience and pattern to create various designs. For example, the apertures 418C may be configured such that they form a gradient type pattern such that when the makeup is applied, the shade of the makeup varies in intensity in any and all directions (e.g., from top to bottom, bottom to top, side to side, etc.). Alternatively, the perforated portion 414C can include cutout shapes and designs which are arranged to create various eye makeup designs. Referring to FIG. 4D, it is to be understood that the first pass-through portion 414D may not include apertures and, thus, does not create a gradient design.

Figure 4E:
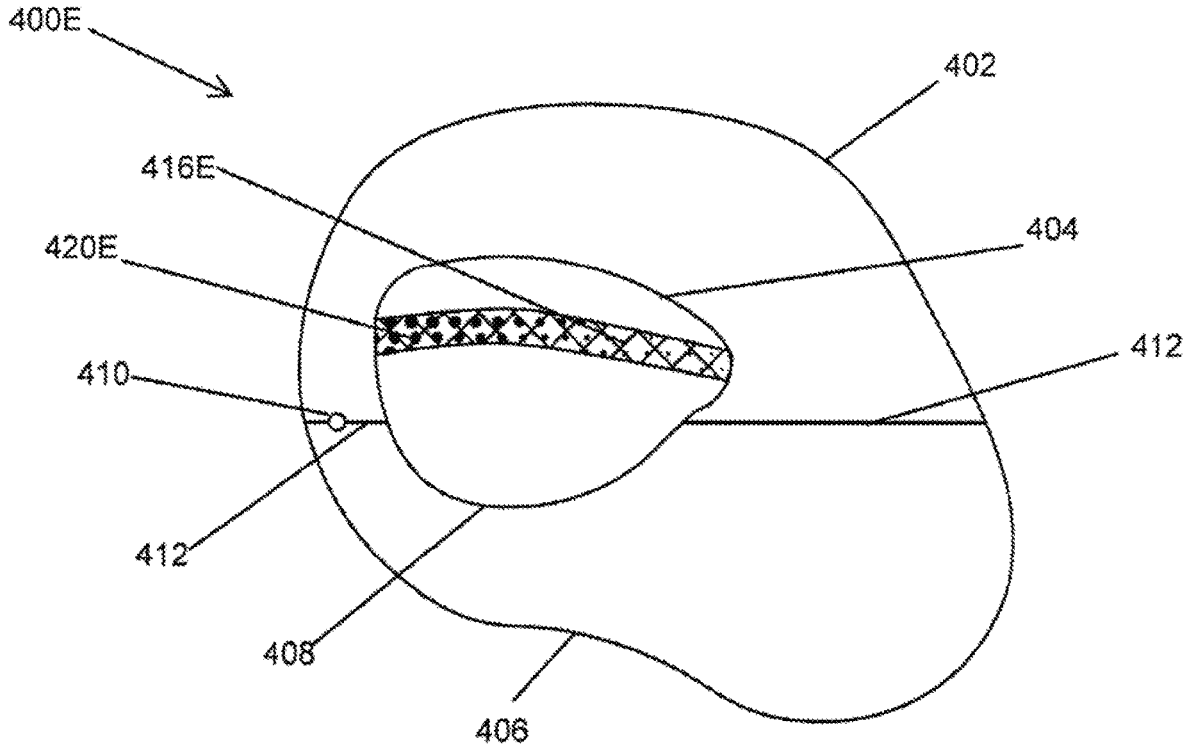
Figure 4F:
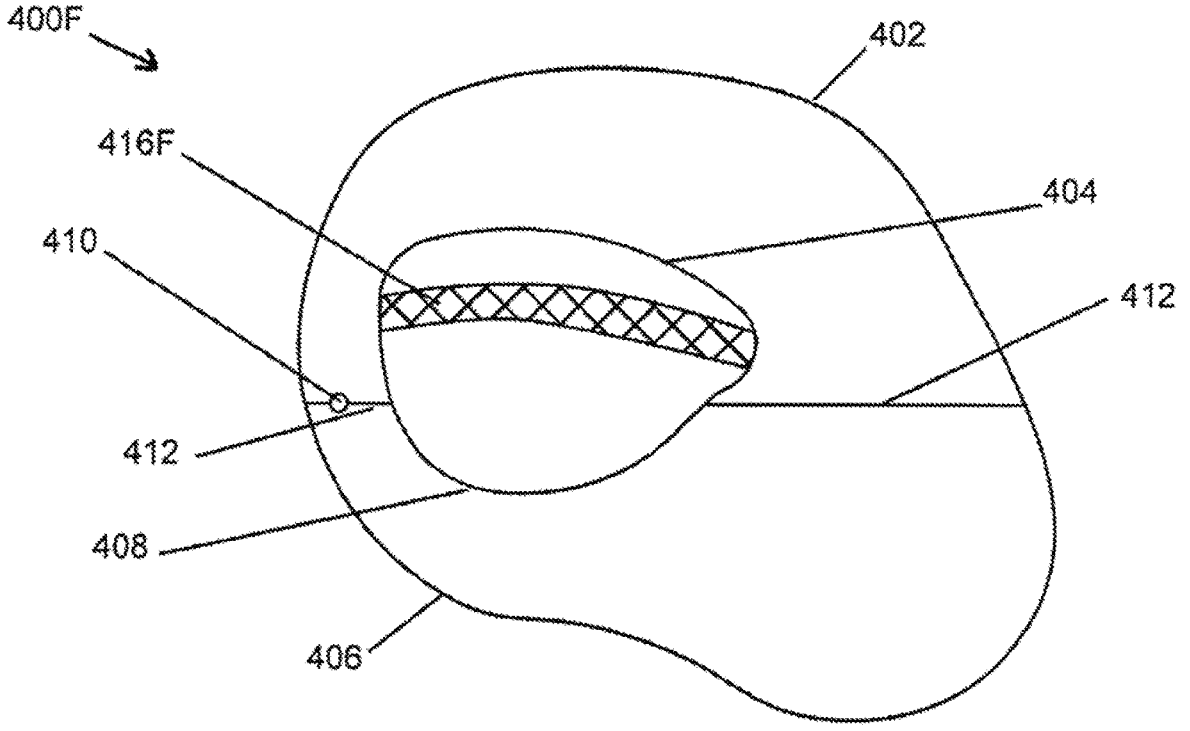

The example embodiments in FIGS. 4E and 4F further include a pass-through (screen) portion 416E, 416F in accordance with another aspect of the innovation. The screen portion 416E, 416F is a mesh like material and may include multiple screen apertures 420E (FIG. 4E) that allows the makeup to pass through the screen portion 416E onto a specific location near the user's eye (e.g., upper eye lid, eye crease, inner and outer corners of the eye, eye brow bone, upper lash line, underneath the eye brow area, etc.). The screen apertures 420E may vary in size, gradience and pattern to create various designs. For example, the screen apertures 420E may be configured such that they form a gradient type pattern such that when the makeup is applied, the shade of the makeup varies in intensity in any and all directions (e.g., from top to bottom, bottom to top, side to side, etc.). Referring to FIG. 4F, it is to be understood, that the screen portion 416F may not include screen apertures and, thus, does not create a gradient design.

Figure 4G:
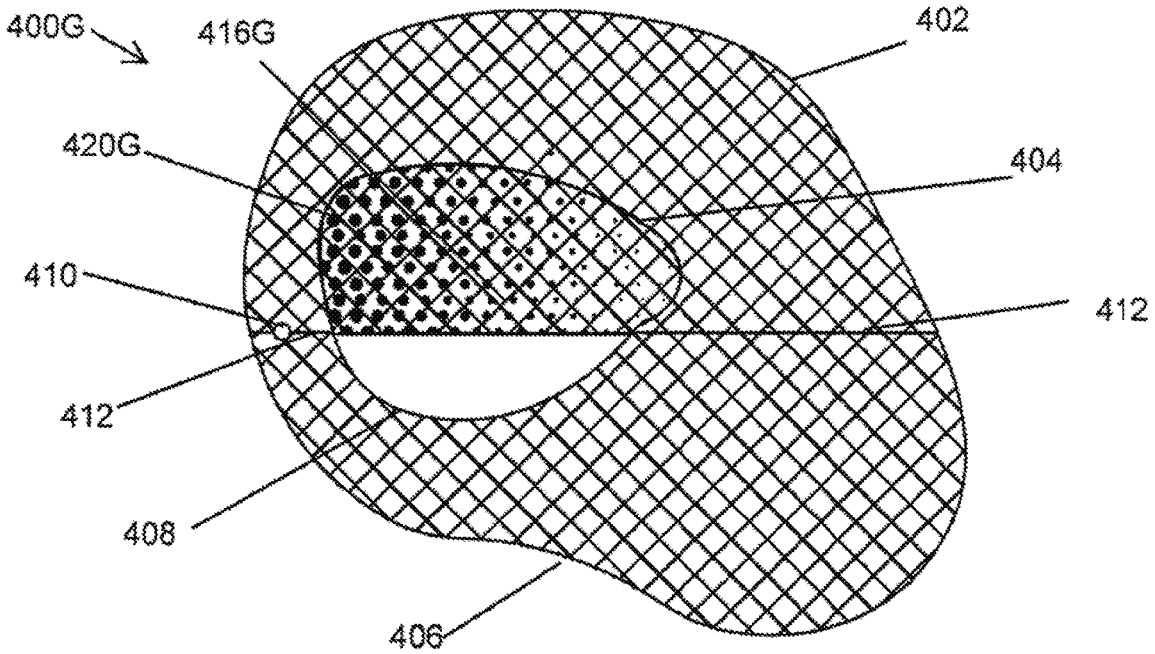
Figure 4H:
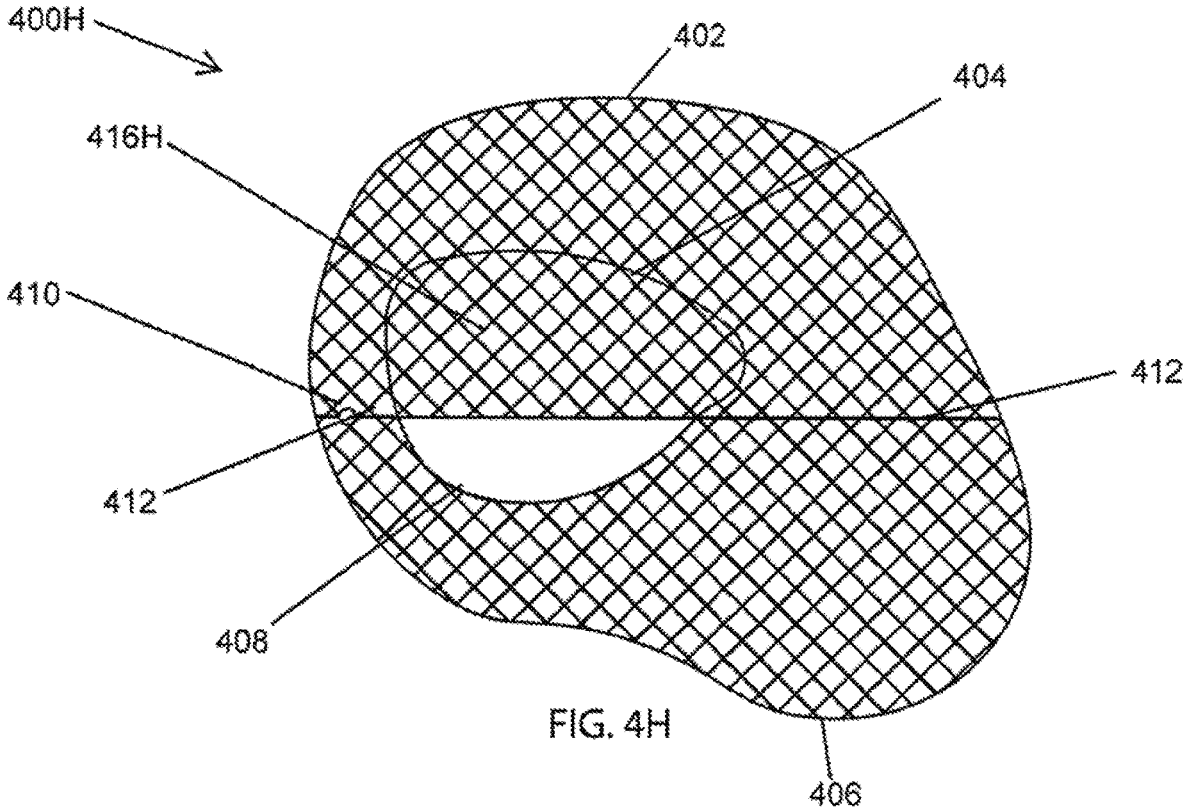

The example embodiments in FIGS. 4G and 4H further include a pass-through (gradient and perforated screen) portion 416G, 416H in accordance with another aspect of the innovation. The screen portion 416G, 416H is a mesh like material and may include multiple screen apertures 420G (FIG. 4G) that allows the makeup to pass through the screen portion 416G onto a specific location near the user's eye (e.g., upper eye lid, eye crease, inner and outer corners of the eye, eye brow bone, upper lash line, underneath the eye brow area, etc.). The screen apertures 420G may vary in size and pattern to create various designs. For example, the screen apertures 420G may be configured such that they form a gradient type pattern such that when the makeup is applied, the shade of the makeup varies in intensity in any and all directions (e.g., from top to bottom, bottom to top, side to side, etc.). Referring to FIG. 4H, it is to be understood, that the screen portion 416H may not include screen apertures and, thus, does not create a gradient design.

Figure 4I:
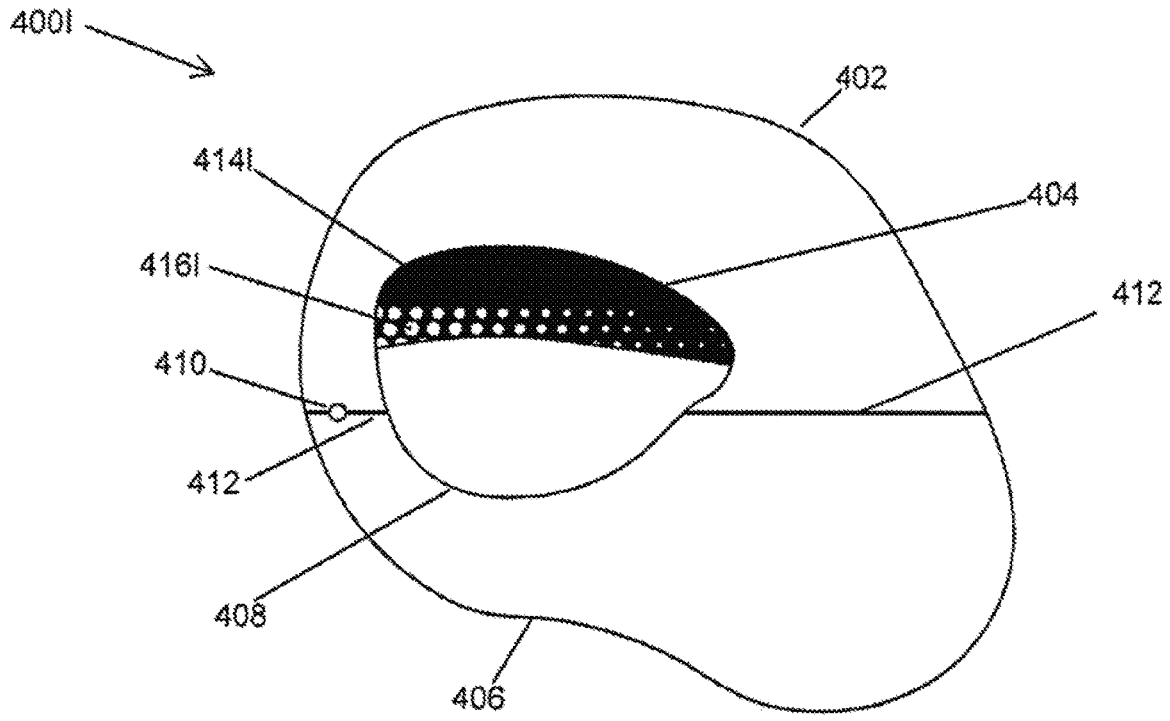
Figure 4J:
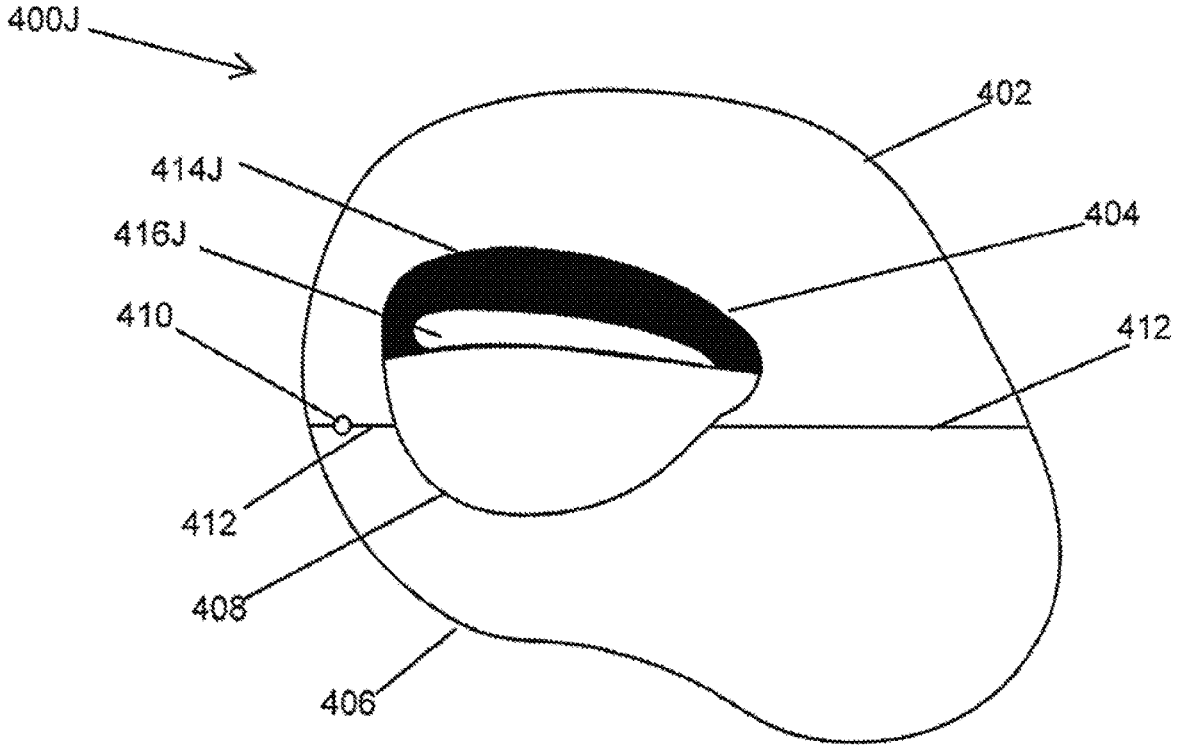

The example embodiments in FIGS. 4I and 4J further include a raised stamp image portion 414I, 414J in accordance with another aspect of the innovation. The raised stamp image portion 416I is attached to the upper portion 402. As shown in FIG. 4I, the raised stamp image portion 414I may include multiple apertures 416I that may vary in size, gradience and pattern to create various designs. For example, the apertures 416I may be configured such that they form a gradient and of fashion type pattern such that when the makeup is applied, the shade of the makeup varies in intensity in any and all directions (e.g., from top to bottom, bottom to top, side to side, etc.). As shown in FIG. 4J, the raised stamp image portion 414J may include a cutout 416J that may vary in size and pattern to create various designs.

To apply makeup, the user coats the raised image stamp portion with makeup using a brush, sponge, air brush, etc. and places the makeup device 400I, 400J over the upper and lower eye lid 102, 116 thereby applying makeup onto a specific location near the user's eye (e.g., upper eye lid 102, eye crease 106, eye brow bone 108, inner and outer corners of the eye 112, 114, etc.).

FIGS. 4K-4T illustrate example embodiments of makeup application assist devices 400K-400T (collectively "400-2" Where applicable) in accordance with an aspect of the innovation. The example embodiments illustrated in FIGS. 4K-4T are similar to the example embodiment illustrated in FIG. 2A, thus, like features will be referenced but not described in detail. The makeup devices 400-2 are adapted to facilitate the application of makeup to an eye area below the eye and include an upper (upper eye) portion 402 having a first cutout portion 404 defined therein and a lower (lower lid) portion 406 having a second cutout (lower application/positioning) portion 408 defined therein, one or more positioning indicators comprised of one or more positioning markers (e.g., aperture, dot, etc.) 410 and one or more positioning lines 412 that assist the user in positioning the makeup device 400-2 on the eye area 100.

Figure 4K:
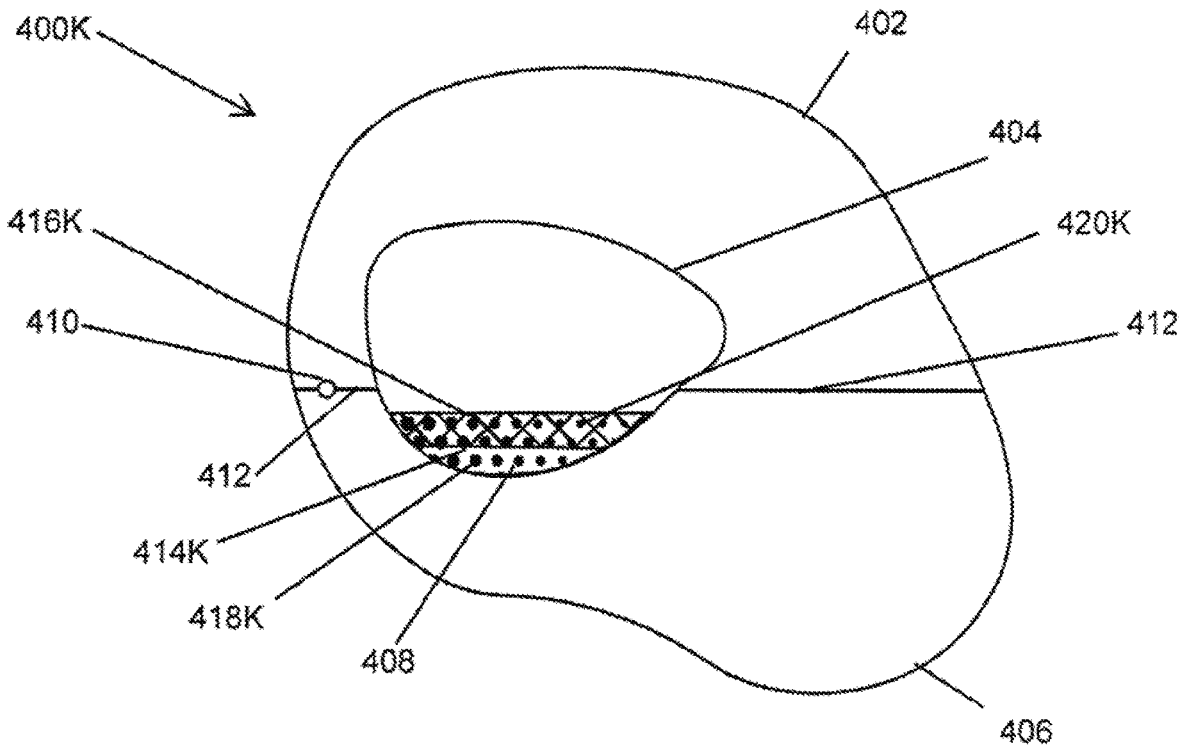
FIGS. 4K-4T are example embodiments of makeup application assist devices adapted to facilitate the application of makeup to areas below the eye in accordance with an aspect of the innovation.
Figure 4L:
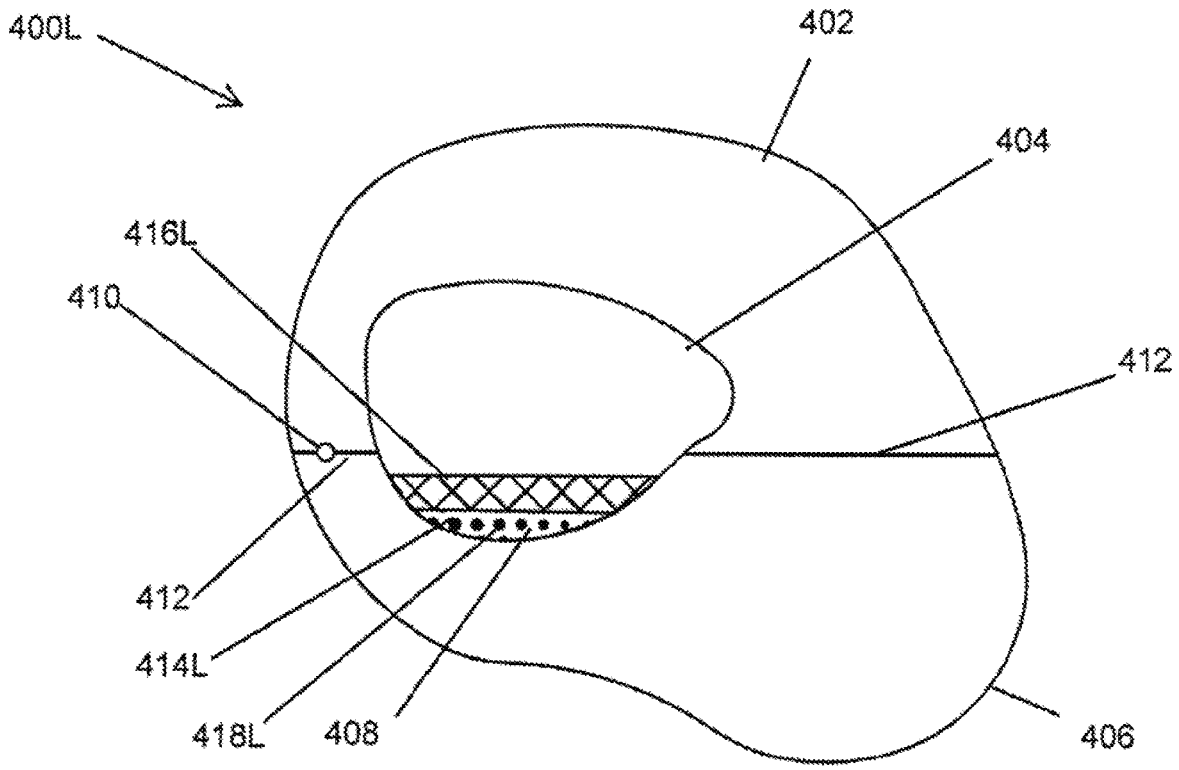

The example embodiments in FIGS. 4K and 4L further include a first pass-through (perforated) portion 414K, 414L and a second pass-through (screen) portion 416K, 416L in accordance with another aspect of the innovation. The perforated portion 414K, 414L is attached to the lower portion 406 and can include apertures 418K, 418L to allow the makeup to pass through the perforated portion 414K, 414L onto a specific location near the user's eye (e.g., lower eye lid 116, lower lash line 118, etc.). The apertures 418K, 414L may vary in size and pattern to create various designs. Alternatively, the perforated portion 414K, 414L can include cutout shapes and designs with are arranged to create various eye makeup designs.

The screen portion 416K, 416K is a mesh like material and can be attached to the perforated portion 414K, 414L. The screen portion 416K may include multiple screen apertures 420K (FIG. 4K) that allows the makeup to pass through the screen portion 416K onto a specific location near the user's eye (e.g., lower eye lid 116, lower lash line 118, etc.). The screen apertures 420K may vary in size, gradience and pattern to create various designs. For example, the screen apertures 420K may be configured such that they form a gradient type pattern such that when the makeup is applied, the shade of the makeup varies in intensity in any and all directions (e.g., from top to bottom, bottom to top, side to side, etc.). Referring to FIG. 4L, it is to be understood, that the screen portion 416L may not include screen apertures and, thus, does not create a gradient design.

Figure 4M:
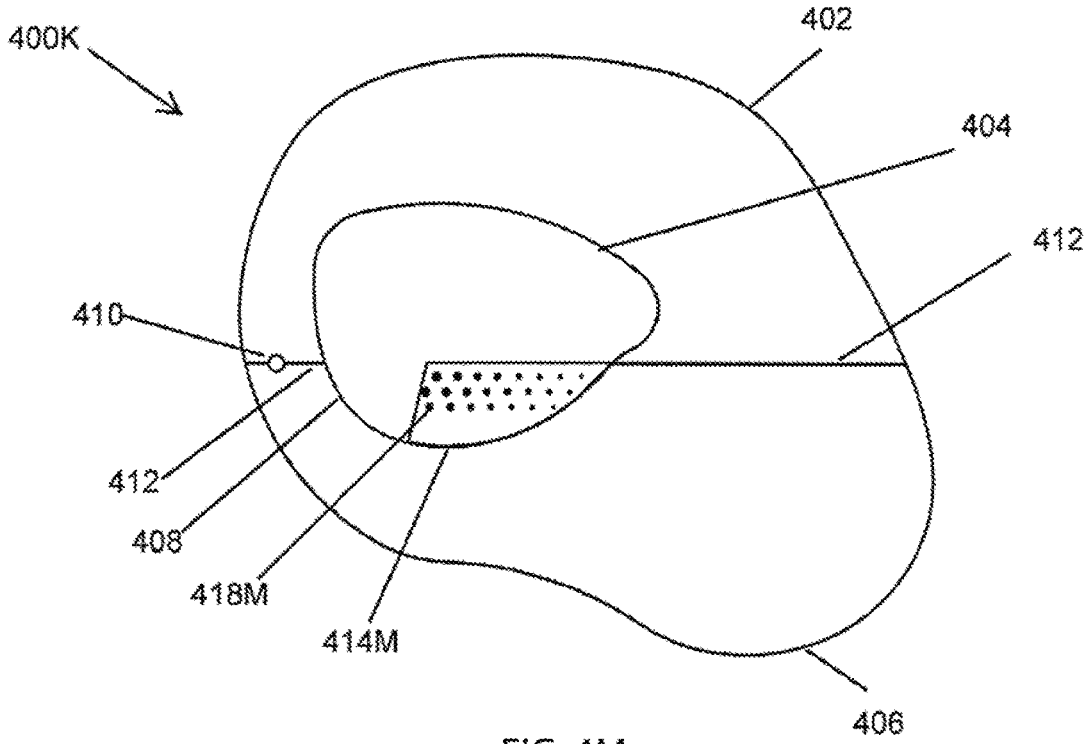
Figure 4N:
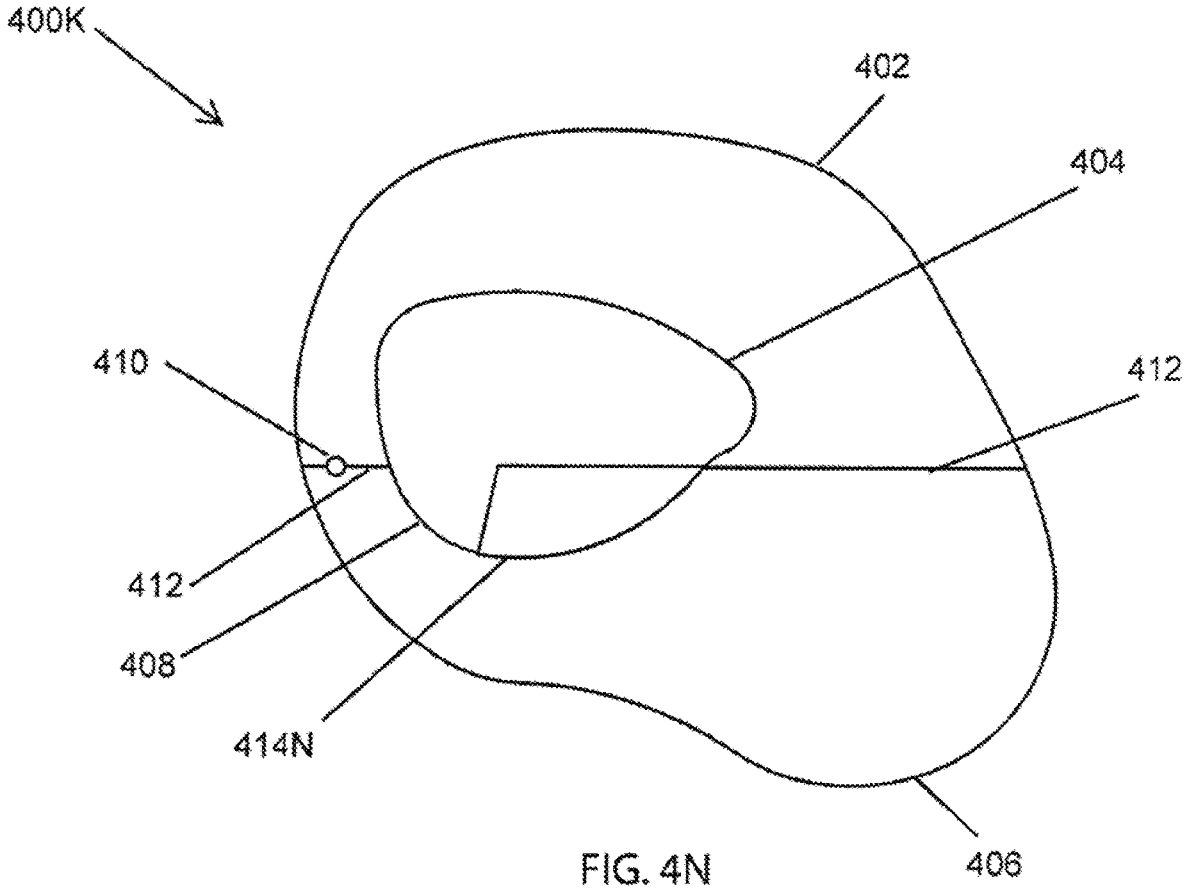

The example embodiments in FIGS. 4M and 4N further include a pass-through (perforated) portion 414M, 414N in accordance with another aspect of the innovation. The perforated portion 414M is attached to the lower portion 406 and can include apertures 418M (FIG. 4M) to allow the makeup to pass through the perforated portion 414M onto a specific location near the user's eye (e.g., lower eye lid 116, lower lash line 118, etc.). The apertures 418M may vary in size, gradience and pattern to create various designs. For example, the apertures 418M may be configured such that they form a gradient type pattern such that when the makeup is applied, the shade of the makeup varies in intensity in any and all directions (e.g., from top to bottom, bottom to top, side to side, etc.). Alternatively, the perforated portion 414M, 414N can include cutout shapes and designs which are arranged to create various eye makeup designs. Referring to FIG. 4N, it is to be understood that the first pass-through portion 414N may not include apertures and, thus, does not create a gradient design.

Figure 4O:
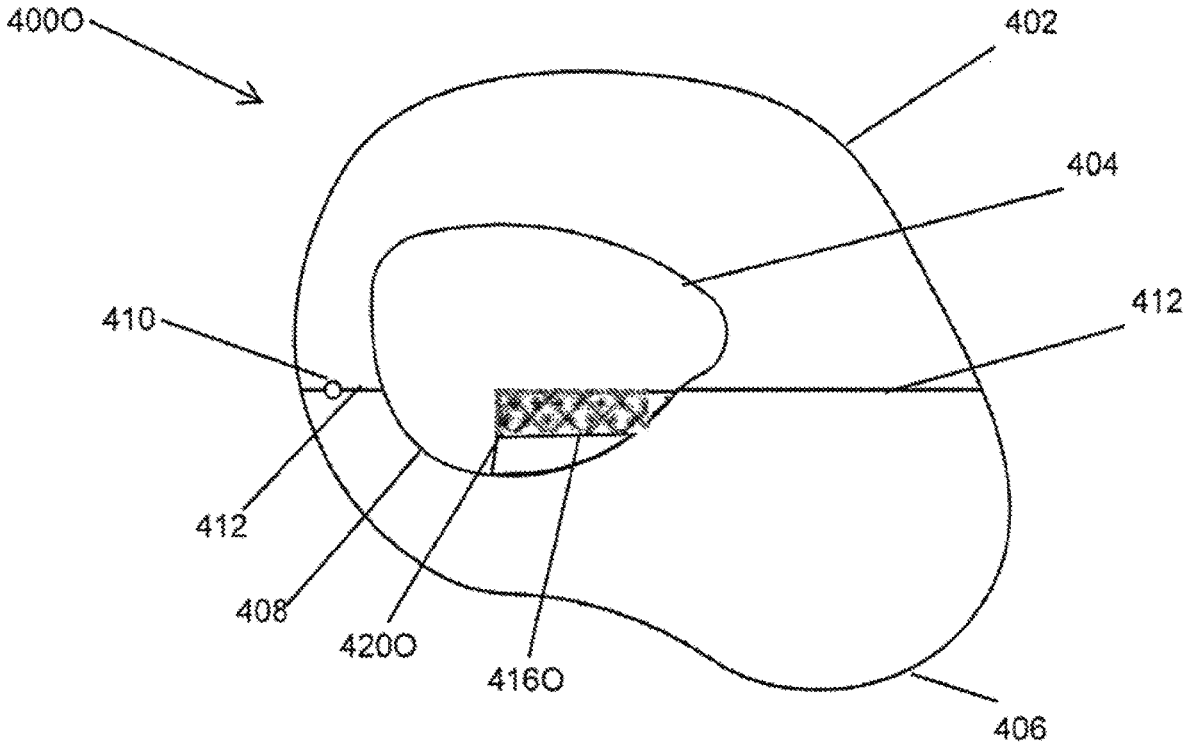
Figure 4P:
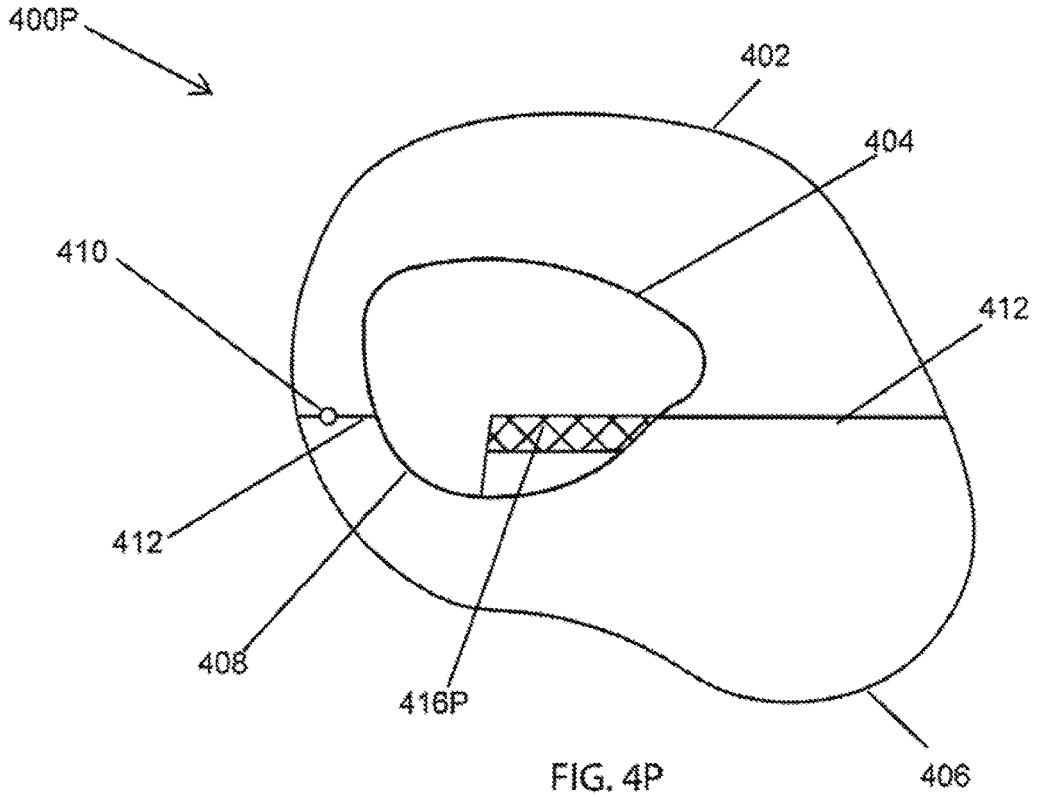

The example embodiments in FIGS. 4O and 4P further include a pass-through (screen) portion 416O, 416P in accordance with another aspect of the innovation. The screen portion 416O, 416P is a mesh like material and may include multiple screen apertures 420O (FIG. 4O) that allows the makeup to pass through the screen portion 416O onto a specific location near the user's (e.g., lower eye lid 116, lower lash line 118, etc.). The screen apertures 420O may vary in size, gradience and pattern to create various designs. For example, the screen apertures 420O may be configured such that they form a gradient type pattern such that when the makeup is applied, the shade of the makeup varies in intensity in any and all directions (e.g., from top to bottom, bottom to top, side to side, etc.). Referring to FIG. 4P, it is to be understood, that the screen portion 416P may not include screen apertures and, thus, does not create a gradient design.

Figure 4Q:
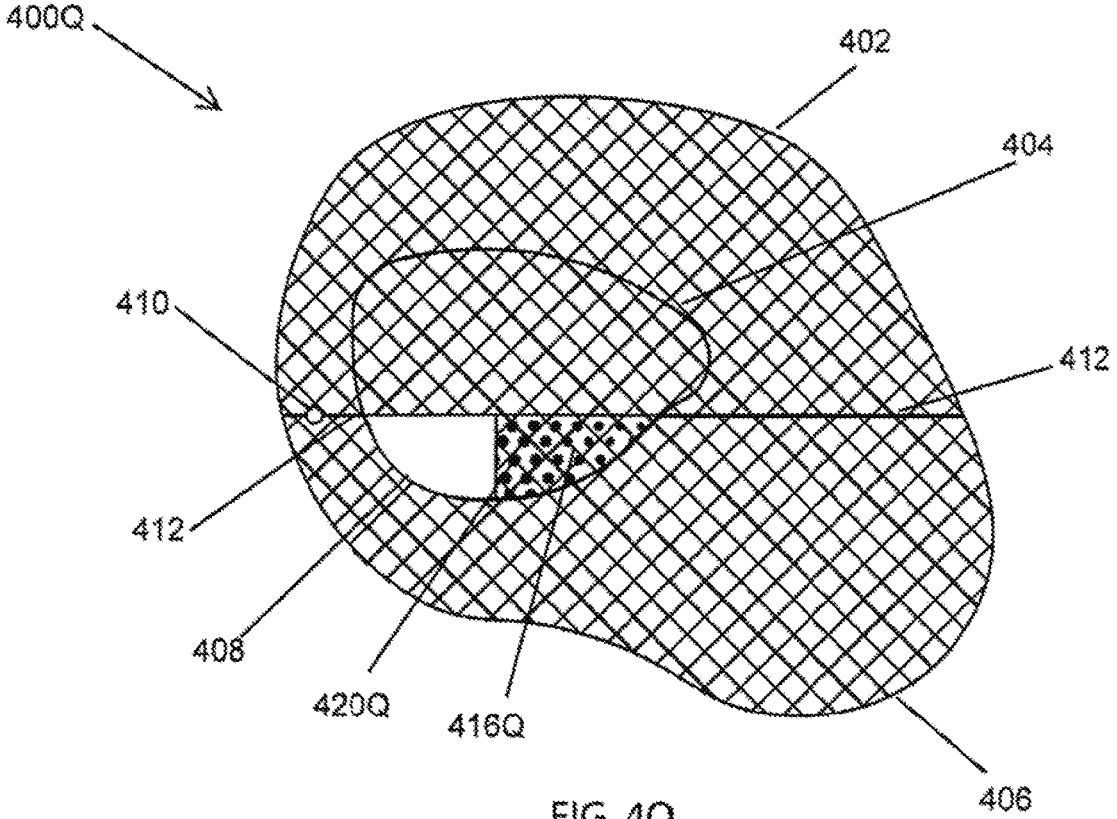
Figure 4R:
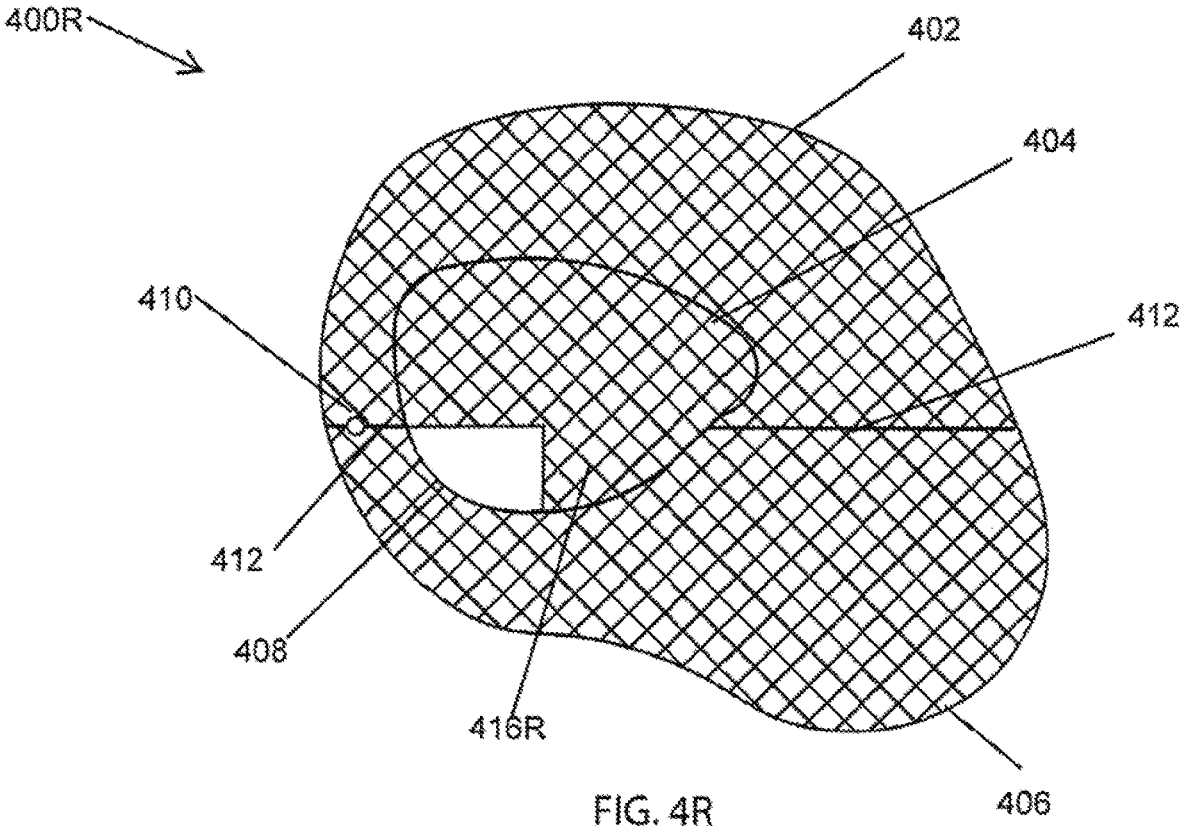

The example embodiments in FIGS. 4Q and 4R further include a pass-through (gradient and perforated screen) portion 416Q, 416R in accordance with another aspect of the innovation. The screen portion 416Q, 416R is a mesh like material and may include multiple screen apertures 420Q (FIG. 4Q) that allows the makeup to pass through the screen portion 416Q onto a specific location near the user's eye (e.g., upper eye lid, eye crease, inner and outer corners of the eye, eye brow bone, upper lash line, underneath the eye brow area, etc.). The screen apertures 420Q may vary in size, gradience and pattern to create various designs. For example, the screen apertures 420Q may be configured such that they form a gradient type pattern such that when the makeup is applied, the shade of the makeup varies in intensity in any and all directions (e.g., from top to bottom, bottom to top, side to side, etc.). Referring to FIG. 4R, it is to be understood, that the screen portion 416R may not include screen apertures and, thus, does not create a gradient design.

Figure 4S:
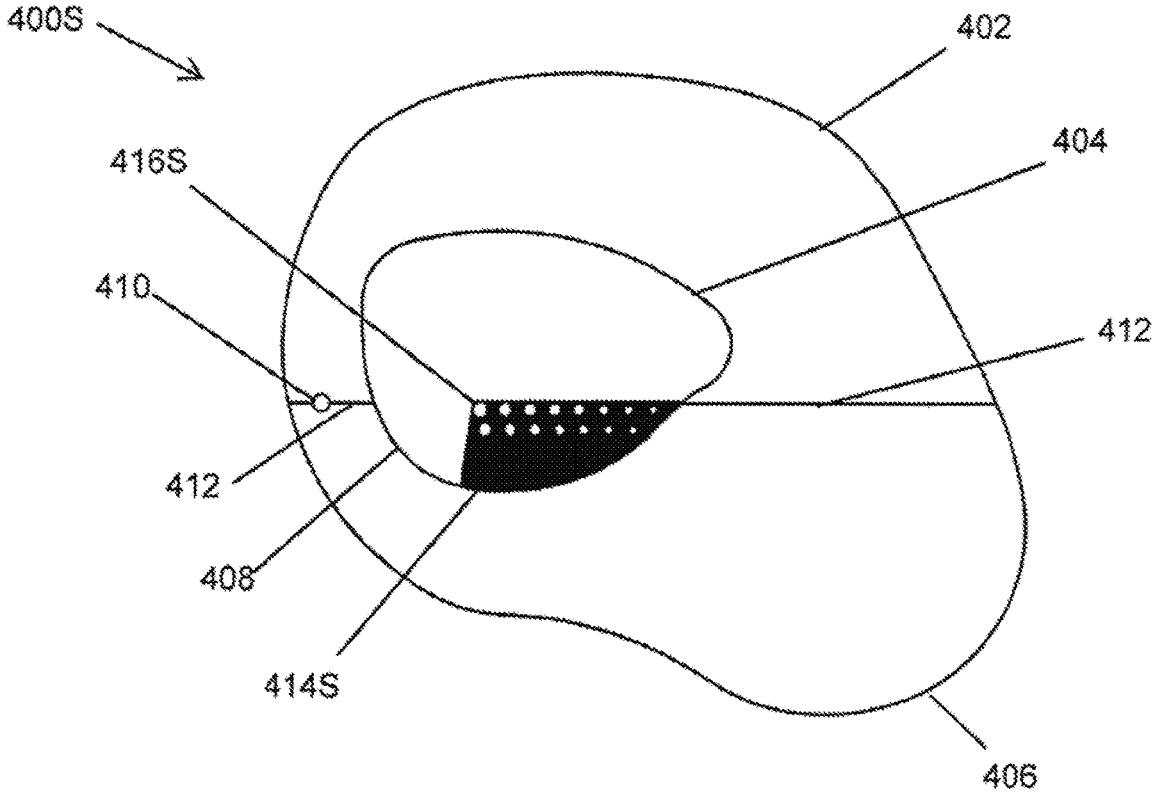
Figure 4T:
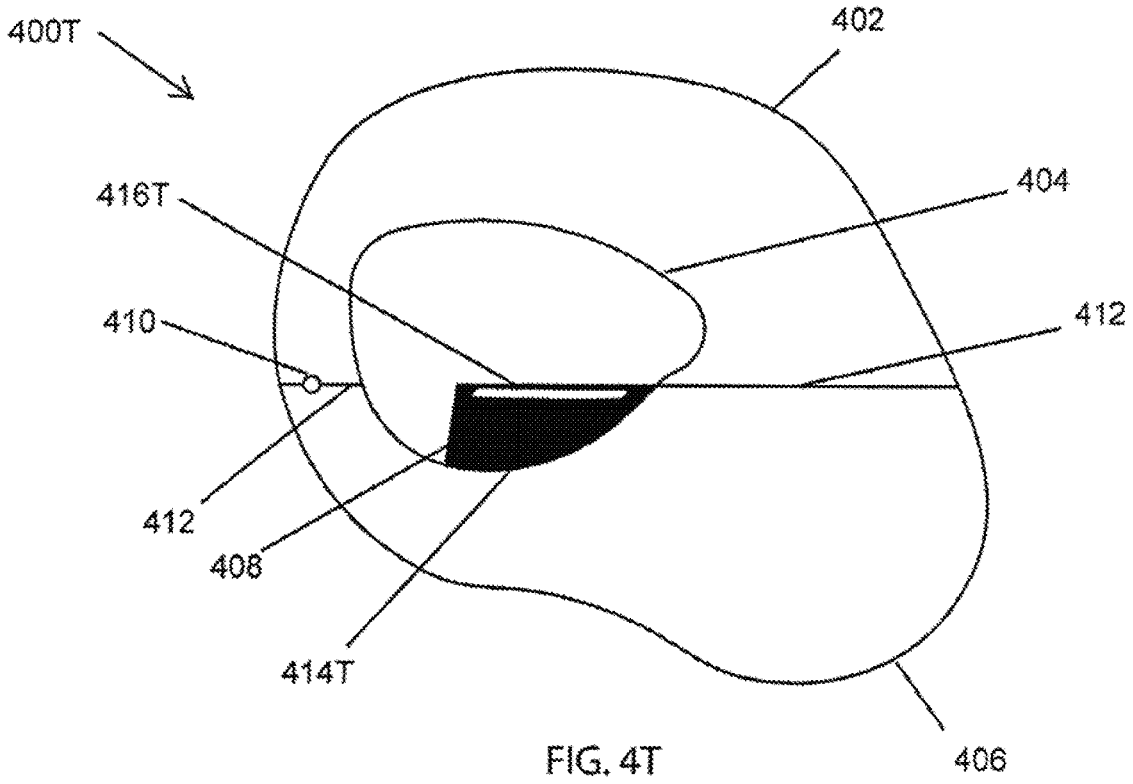

The example embodiments in FIGS. 4S and 4T further include a raised stamp image portion 414S, 414T in accordance with another aspect of the innovation. The raised stamp image portion 414S is attached to the upper portion 402. As shown in FIG. 4S, the raised stamp image portion 414S may include multiple apertures 416S that may vary in size, gradience and pattern to create various designs. For example, the apertures 416S may be configured such that they form a gradient and or fashion type pattern such that when the makeup is applied, the shade of the makeup varies in intensity in any and all directions (e.g., from top to bottom, bottom to top, side to side, etc.). As shown in FIG. 4T, the raised stamp image portion 414T may include a cutout 416T that may vary in size and pattern to create various designs.

To apply makeup, the user coats the raised image stamp portion with makeup using a brush, sponge, air brush, etc. and places the makeup device 400S, 400T over the upper and lower eye lid 102, 116 thereby applying makeup onto a specific location near the user's eye (e.g., lower eye lid 116, lower eye lash line 118, etc.).

Figure 4U:
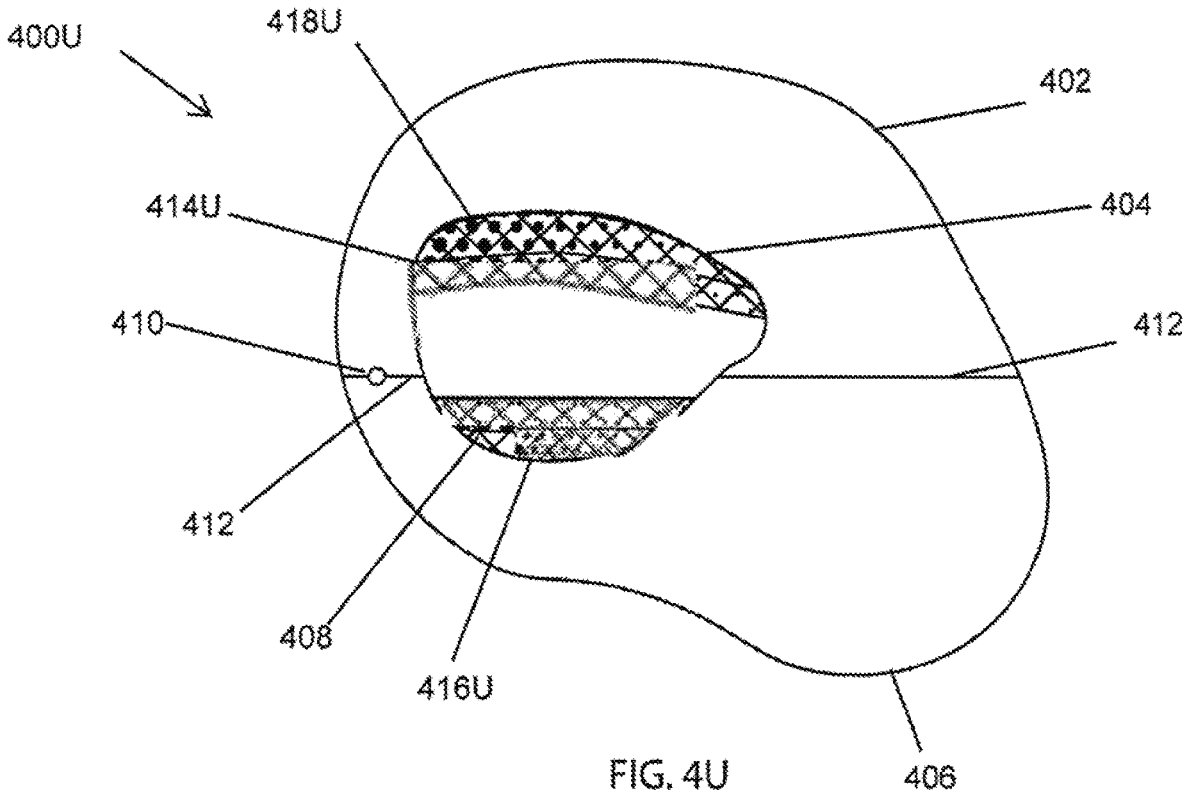
FIG. 4U is another example embodiment of a combination makeup application assist device in accordance with an aspect of the innovation.

FIG. 4U is another example embodiment of a makeup device (stencil) 400U that includes both the upper and lower portions of the stencil in accordance with an aspect of the innovation. Specifically, the makeup device 400U illustrated in FIG. 4U is a combination makeup device 400U that includes a first portion 402 having a first cutout portion 404 adapted to facilitate the application of makeup to an eye area above the eye and a second portion 406 having a second cutout portion 408 adapted to facilitate positioning and to facilitate the application of makeup to the eye area below the eye.

The makeup device 400U further includes one or more positioning indicators comprised of one or more positioning markers (e.g., aperture, dot, etc.) 410 and one or more positioning lines 412 that assist the user in positioning the makeup device 400U on the eye area 100 similar to the positioning indicators described above.

The combination makeup device 400U may include any combination of the makeup devices 400A-400K adapted to facilitate the application of makeup to the area above the eye, as shown in FIGS. 4A-4J, and makeup devices 400K-400T adapted to facilitate the application of makeup to the area below the eye, as shown in FIGS. 4K-4T, For example, the combination makeup device 400U shown in FIG. 4U includes a first pass-through screen portion 414U and a second pass-through portion 416U. In this example, the first pass-through screen portion includes apertures 418U and the second pass-through screen portion does not include apertures.

The makeup application assist devices 200A-200I, 300, and 400A-400U disclosed herein can be adapted/modified for the application of various eye shadow fashion designs (e.g., natural/daytime, evening/smoky, sophisticated, etc.) and corresponding eye shadow design application process steps. For example, the makeup application assist devices 200A-200I, 300, and 400A-400U may be modified to include different gradient and or fashion patterns and quantities of perforation for various eye shadow design application steps. In addition, the makeup application assist devices 200A-200I, 300, and 400A-400I can be tailored to include various cutout designs, various quantities and patterns of perforation and or various gradient and or perforated screen patterns arranged for application of specific eye shadow designs and corresponding application process steps and potentially more than one variation of each step (e.g., base eye shadow, contour eye shadow color, highlight eye shadow, crease eye shadow, and other eye shadow design application process steps).

Figure 5B:
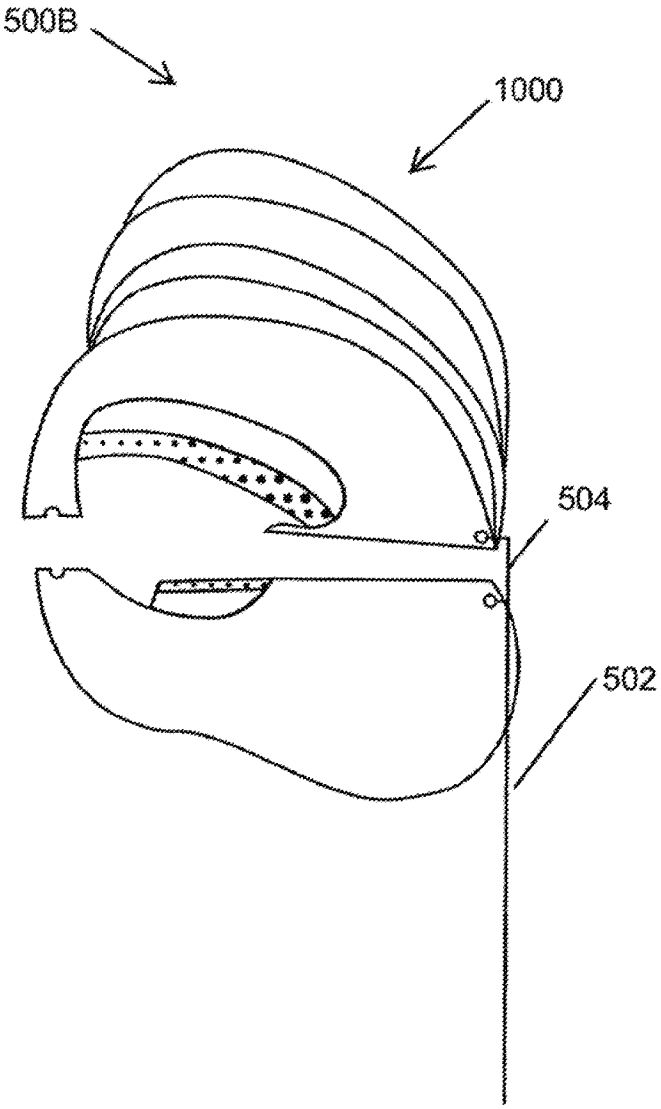
FIGS. 5A and 5B are example embodiments of makeup application assist device kits in accordance with an aspect of the innovation.
Figure 5A:
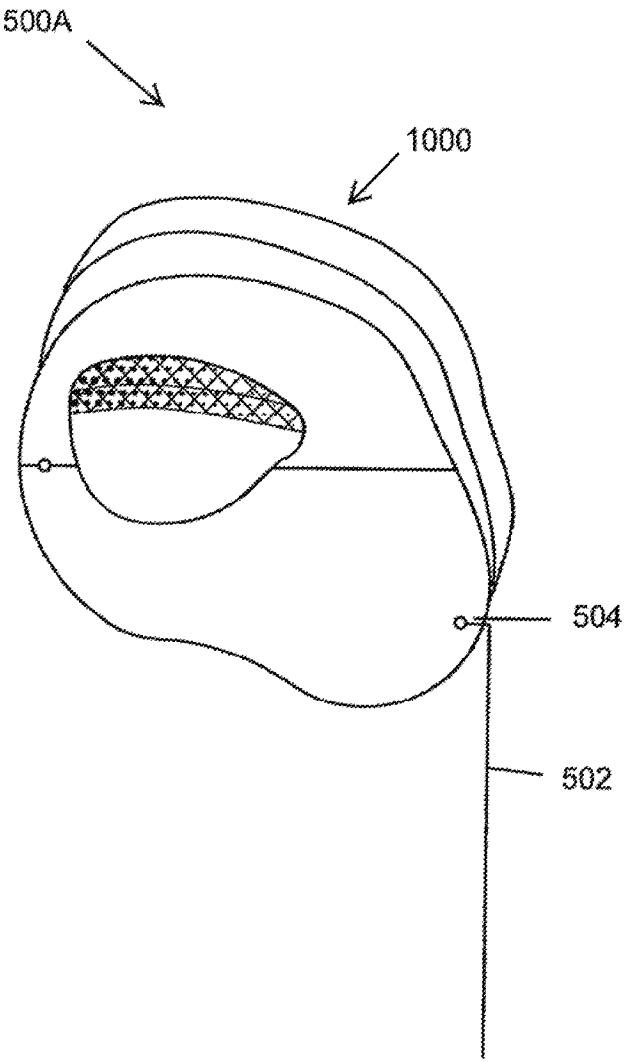

Referring to FIGS. 5A and 5B, the makeup application assist devices 200, 300, 400-1, and 400-2 (collectively "1000" hereinafter where applicable) disclosed herein can be configured into a system or kit 500A, 500B. More specifically, multiple makeup application assist devices 1000 can be mixed and or matched to provide any type of makeup kit desired. For example, in one example embodiment, a complete kit may include one of each of the base stencil 200A, the contour stencil 200B, the eye crease stencil 200E, the highlight stencil 200E and the eye liner stencil 200G. In another embodiment, another kit may be a partial kit and can include any combination of the above mentioned stencils. In another embodiment, modifications of the above mentioned stencils as disclosed herein may be combined to form kits that facilitate the application of eye makeup layers to different and or overlapping areas of the eye area 100.

Still referring to FIGS. 5A and 5B, in one example embodiment, the multiple makeup devices 1000 can be attached to each other with an attachment device 502. For example, the attachment device 502 can be a small rod (shown in the figures), a clip, a clamp, etc. to assist in the application of the makeup. In the example embodiment of FIGS. 5A and 5B, a hinged mechanism 504 may be provided that connects each makeup device 1000 to the attachment device 502 to further assist the user in applying the makeup. Still further, each makeup device 1000 can be adapted to be removable from the attachment device 502 and or the hinged mechanism 504, to facilitate the interchangeability of multiple makeup devices 1000.

In another example embodiment, the makeup devices 1000 can be color coded and or numbered to match corresponding colors of makeup to facilitate the application of makeup.

Figure 6A:
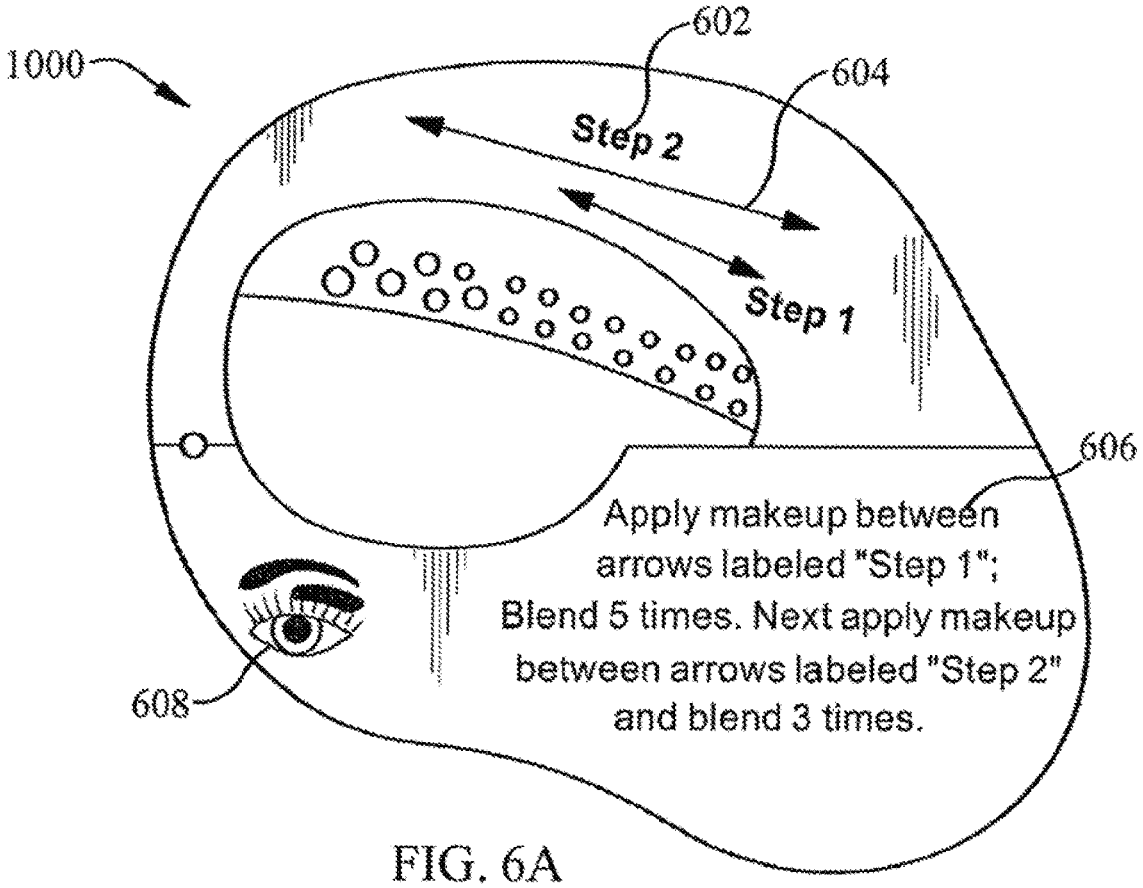
FIGS. 6A and 6B are example embodiments of makeup application assist devices that include instructions in accordance with an aspect of the innovation.
Figure 6B:
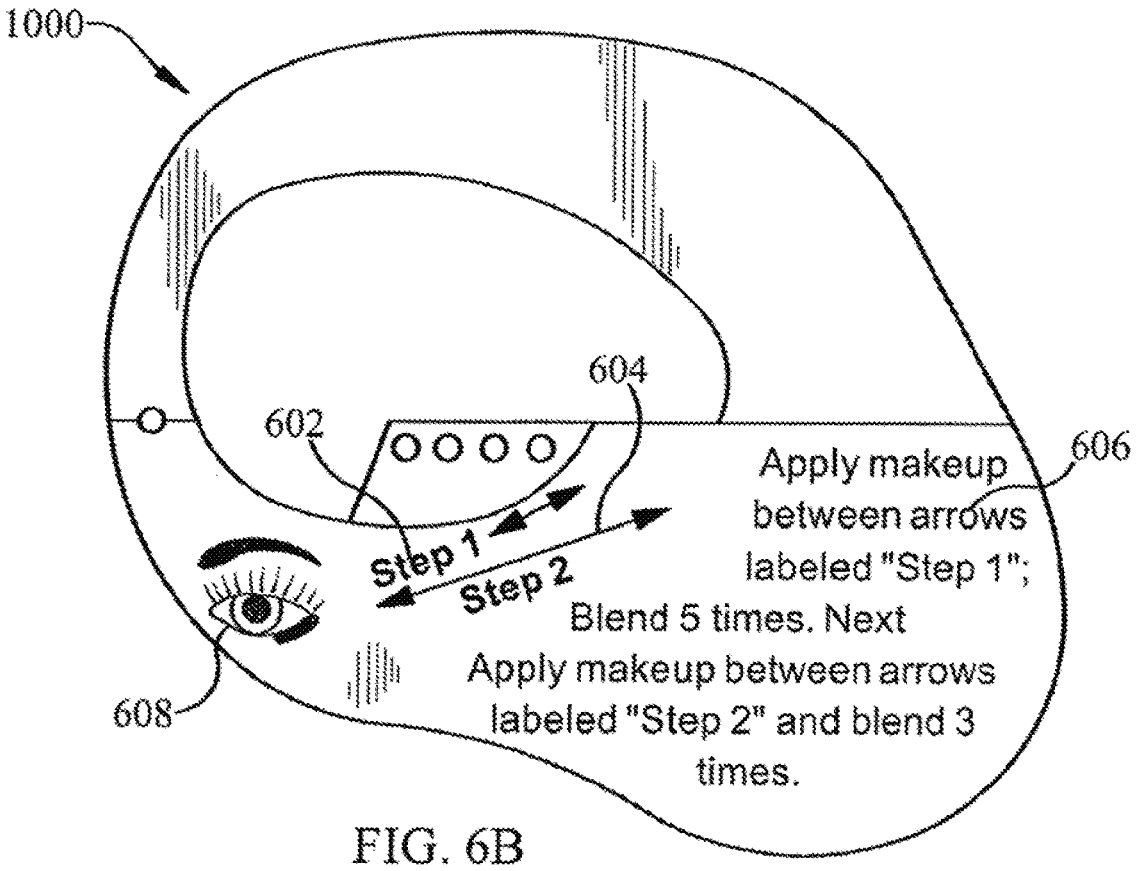

Referring to FIGS. 6A and 6B, in another embodiment, the makeup devices 1000 can include instructions to aid the user in the application, concentration and blending of eye makeup. The instructions may include a step-by-step process comprised of numbered steps 602, lines 604 indicating where to apply the makeup, worded directions 606 advising the user how to apply the makeup, icons 608 indicating the parts of the eye area 100 to apply makeup.

Figure 7:
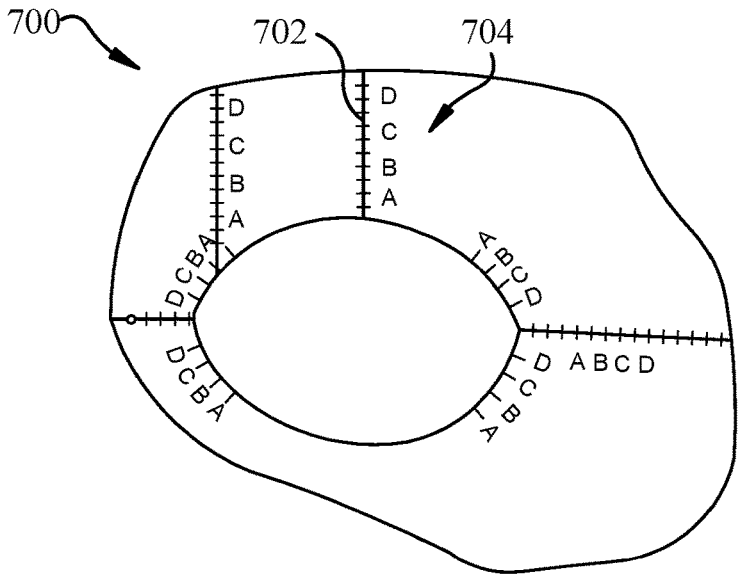
FIG. 7 is an example embodiment of an eye measuring device in accordance with an aspect of the innovation.

Referring to FIG. 7, a measuring device 700 can be provided to measure the users' eye shape and size to assist the user in determining the appropriate size makeup device 1000. The measuring device 700 can be provided as a stand-alone item or as part of a kit described above. The measuring device 700 can include incremental markers 702 and measurements 704 along the length, width (top to bottom and bottom to top), and middle (top to bottom and bottom to top), curvature of the eye shapes and sizes. The measuring device 700 can measure the following: (1) eye lid height from inner corner of the eye to the inner corner of the eye brow, (2) the length of the eye brow from the inner corner of the eye lid to the outer end of the eye brow, (3) eye lid width from the inner corner of the eye to the outer corner of the eye, (4) middle of the eye lashes to the eye crease, (5) middle of the eye crease to beneath the eye brow, (6) curvature of the eye lid, and (7) curvature of the eye brow hone. It is to be understood, that the measuring device 700 can be made flat or in various shapes and curvatures to correspond with different eye shapes, sizes and curvatures and aid in identifying a user's eye shape, curvature and size. The measuring device 700 provides a means to provide customized sizes to match any eye shape.

Figure 8:
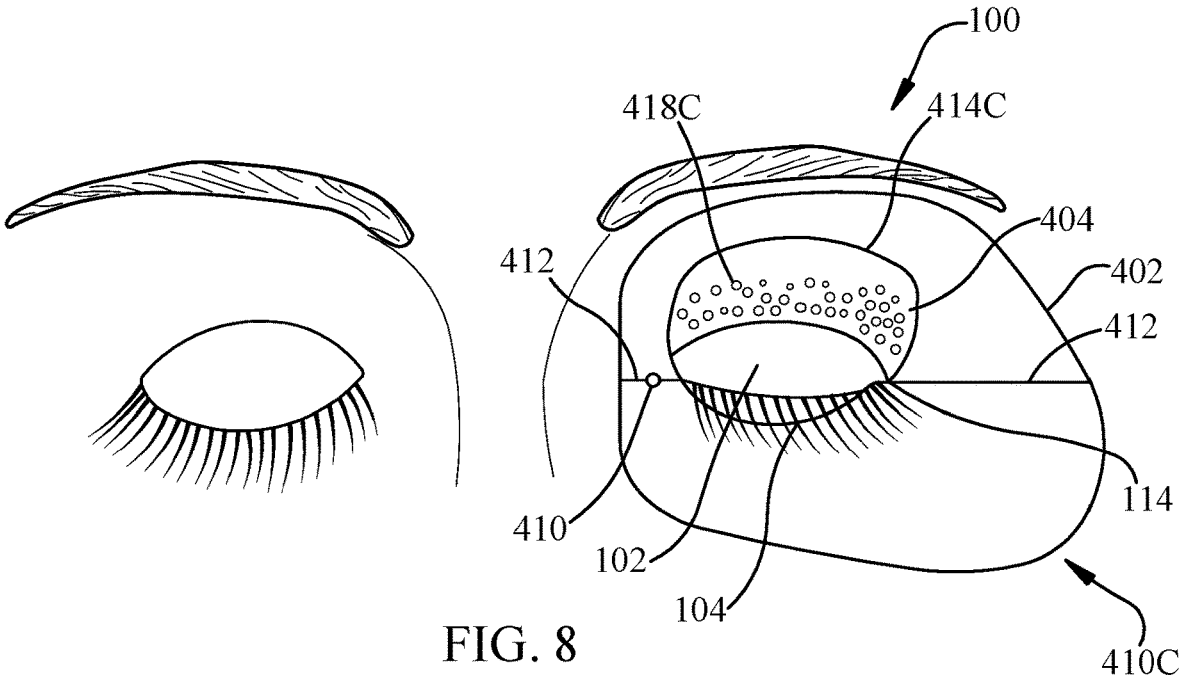
FIG. 8 illustrates the use of a makeup application assist device on a user in accordance with an aspect of the innovation.
Figure 9:
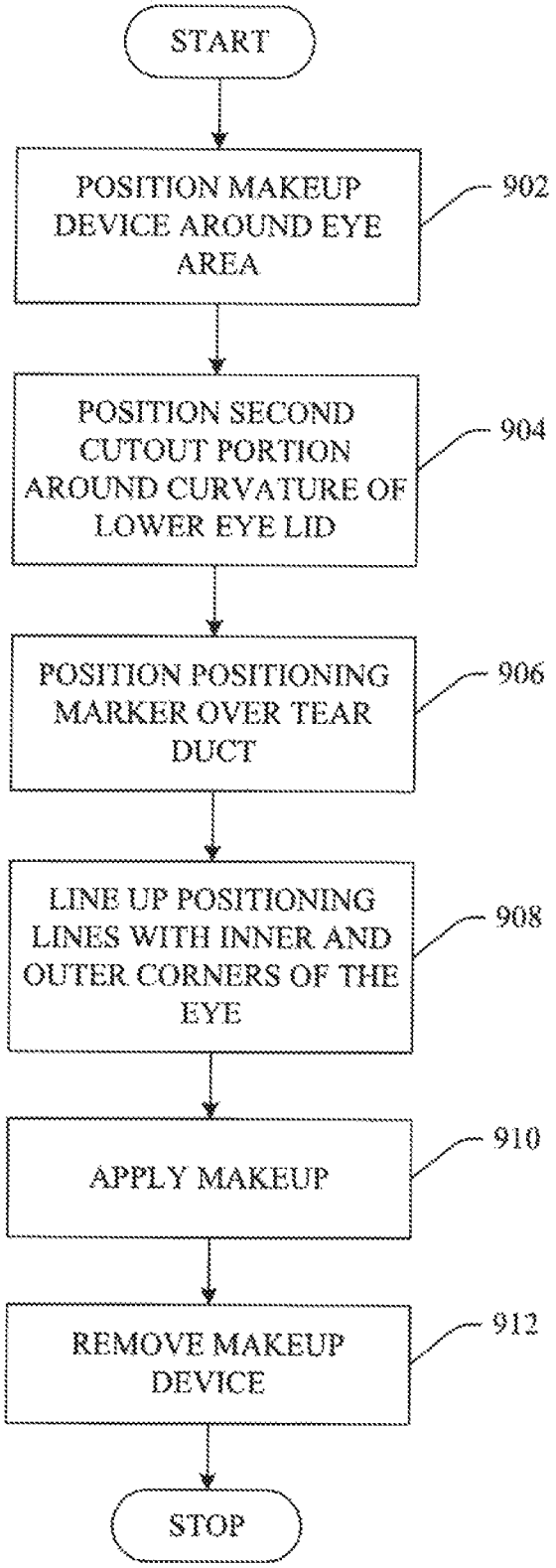
FIG. 9 is an example flow chart illustrating a method of applying makeup in accordance with an aspect of the innovation.

Using FIGS. 1 and 4C as a references and referring to FIGS. 8 and 9, a method of applying makeup utilizing the innovative makeup application assist device 400C will now be described. At 902, position makeup stencil 400C around the eye area 100. At 904, position the second cutout 408 around the curvature of the lower eye lid 116. At 906, position the positioning marker 410 over the user's tear duct. At 908, the positioning lines 412 are lined up with the inner and outer eye corners 112, 114 where the upper and lower eye lash lines 104, 118 meet. At 910, the user sequentially applies eye makeup using a brush, swab, sponge, air brush tool, etc. to the corresponding exposed area (i.e., not covered by the makeup device) of the eye area 100. For example, the makeup device 400C shown in FIG. 8 facilitates the application of makeup to the upper eye lid 102 and a design to the crease area 106 and area below the eye brow 109 via the apertures 4180 in the perforated portion 414C. At 912, the user removes the makeup device 400C to expose the eye makeup design. The makeup device 400C allows makeup to pass through the apertures 418C while preventing the application of makeup where the apertures 418C are not present.

As an option, the method may further include measuring a shape and size of the eye with the measuring device 700 described above and determining a proper size of the makeup application assist device 410C based on the measurement.

The advantages of the innovative makeup application assist device described herein include: (i) assists a user in applying various one or multiple step and color eye shadow designs specific to the users' eye size and shape, (ii) creates a more consistent and symmetrical eye shadow design application, (iii) decreases time spent during the application process, (iv) improves efficiency of the application process, (v) expands the users' ability to apply various complex eye shadow designs, and (vi) easy to position on the eye area and as a result, consistently apply makeup to the corresponding areas of the eye.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of applying makeup to a user's eye comprising:

providing a stencil that defines a plurality of apertures, wherein the apertures vary in size or distance from each other to form a gradient pattern; wherein the stencil further defines a positioning aperture that is separate from the plurality of apertures;

positioning the stencil relative to the user by placing the positioning aperture over a tear duct of the user; and applying makeup through the apertures of the stencil to a specific area around the user's eye.

2. A method of applying makeup to a user's eye comprising:

providing a stencil that defines a plurality of apertures, wherein the apertures vary in size or distance from each other to form a gradient pattern; wherein the stencil further defines a positioning aperture that is separate from the plurality of apertures;

positioning the stencil relative to the user by placing the positioning aperture over a tear duct of the user;

applying a first amount of makeup through a first proportion of the plurality of apertures to a specific area around the user's eye;

blending the first amount of makeup applied to the specific area;

applying a second amount of makeup through a second proportion of the plurality of apertures to the specific area; and blending the second amount of makeup applied to the specific area.

3. The method according to claim 1, wherein the plurality of apertures are configured such that the makeup as applied to the specific area through the plurality of apertures varies in shade intensity across the specific area.

4. The method according to claim 1, further comprising a step of blending the makeup applied to the specific area through the plurality of apertures.

5. The method according to claim 1, wherein the plurality of apertures vary in distance from each other.

6. The method according to claim 1, wherein the plurality of apertures vary in size.

7. The method according to claim 1, wherein the plurality of apertures vary in size and distance from each other.

8. The method according to claim 1, wherein the specific area corresponds to an upper eye lid, an eye crease, an eye brow bone, an upper lash line, an area underneath the eye brow, an inner corner of the eye, an outer corner of the eye, a lower eye lid, or a lower lash line of the user.

9. The method according to claim 1, wherein: the stencil further comprises a cutout portion, and the stencil is positioned relative to the user such that the cutout portion fits around a curvature of an eyelid of the user.

10. The method according to claim 9, wherein the eyelid corresponds to an upper eyelid of the user.

11. The method according to claim 9, wherein the eyelid corresponds to a lower eyelid of the user.

12. The method according to claim 1, wherein:

the stencil includes a positioning line; and wherein the positioning of the stencil includes positioning the stencil such that the positioning line aligns with inner and outer eye corners of the user.

13. The method according to claim 11, wherein the positioning line intersects with one side edge of the stencil and a second side edge of the stencil.

14. The method according to claim 11, wherein the positioning line is a straight line.

15. The method according to claim 11, wherein the positioning line is formed by an edge of the stencil.

16. The method according to claim 1, wherein the stencil is a single piece.

17. The method according to claim 1, wherein the stencil is formed by at least two separate pieces.

18. The method according to claim 2, wherein the step of applying the second amount of makeup through the second proportion of the plurality of apertures includes also applying the second amount of makeup through the first proportion of the plurality of apertures.

* * * * *